US006652328B2

(12) United States Patent
Suzuki

(10) Patent No.: US 6,652,328 B2
(45) Date of Patent: Nov. 25, 2003

(54) COUPLING STRUCTURE FOR CONNECTORS WITH HOLDER

(75) Inventor: Kenji Suzuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/144,023

(22) Filed: May 14, 2002

(65) Prior Publication Data

US 2002/0168896 A1 Nov. 14, 2002

(30) Foreign Application Priority Data

May 14, 2001 (JP) ..... P2001-143178

(51) Int. Cl.[7] ..... H01R 13/514
(52) U.S. Cl. ..... 439/752; 439/595
(58) Field of Search ..... 439/752, 595

(56) References Cited

U.S. PATENT DOCUMENTS 5,575,683 A 11/1996 Saito et al. ..... 439/595
5,722,857 A * 3/1998 Saito et al. ..... 439/595
5,860,822 A * 1/1999 Nishide et al. ..... 439/206
5,934,946 A * 8/1999 Nakamura ..... 439/752
6,139,374 A * 10/2000 Kennedy et al. ..... 439/752

FOREIGN PATENT DOCUMENTS

GB 2 262 664 A 6/1993
GB 2 262 664 A 9/1996
JP 11-86950 3/1999

* cited by examiner

*Primary Examiner*—Tulsidas Patel
(74) *Attorney, Agent, or Firm*—Sughrue Mion, PLLC

(57) ABSTRACT

There is provided with one connector (C1) which is configured by containing within a connector housing (10) a terminal (40), a holder (20) for protecting or holding the terminal (40) and a spacer (30) for doubly engaging the terminal (40) and the other connector (C2) which is configured by containing within the other housing (70) the other terminal (90). When the front surface (72*c*') of the other connector (C2) pushes with pressure the front surface (22*c*') of the holder (20) housed within the connector housing (10), the holder (20) is regularly engaged with the connector housing (10) of the one connector (C1) and, simultaneously, the terminal (40) of the one connector (C1) is coupled to the other terminal (90) of the other connector (C2), whereby the fitting operation between the one connector (C1) and the other connector (C2) is performed.

5 Claims, 24 Drawing Sheets

COUPLING STRUCTURE FOR CONNECTORS WITH HOLDER

BACKGROUND OF THE INVENTION

1. Field of the Invention

The present invention relates to a connector with holders used in an automobile etc. and particularly relates to a connector with holders which can surely engage a holder such as a front holder with a connector housing.

The present application is based on Japanese Patent Application No. 2001-143178, which is incorporated herein by reference.

2. Related Art

FIGS. 22 to 25 show an example of a connector having a conventional insertion detecting member for a terminal metal member disclosed in Japanese Patent Laid-Open No. JP-A-11-86950.

In FIG. 22, a reference character A depicts a connector having a connector housing made of synthetic resin and a reference character B depicts an insertion detecting member for a terminal metal member made of synthetic resin. The connector A includes a terminal metal member C (FIG. 23B, FIG. 24B) and a connector housing formed by a housing main body portion A1 and a hood portion A2 expanded through a step portion A3 at the front portion of the housing main body portion etc.

As shown in FIG. 23B, a plurality of terminal housing chambers 1 are provided as upper and lower stages within the housing main body portion A1. Within each of the terminal housing chambers 1, a stopper 2 is provided at the front end thereof, and a cantilever type flexible engaging piece 3 extending forward through a supporting base portion 3*a* provided at a wall 9 is formed at the lower portion of the terminal housing chamber. An engaging projection 3*b* is provided at the front free end portion of the flexible engaging piece 3, and a flexible displacement allowing space 4 is formed between the flexible engaging piece 3 and the one wall 9 of the terminal housing chamber 1. A locking engaging frame portion 5 is provided at the upper portion of the hood portion A2.

As shown in FIG. 22, in the terminal metal member insertion detecting member B, a plurality of insertion detecting bodies 7 which extend forward in correspondence to the flexible displacement allowing spaces 4 are provided at the intermediate portion and the lower portion of a main frame portion 6 with a thin width in the forward and backward direction, and further a pair of pieces 8 extending in the forward direction are provided at the both side portions of the main frame portion. The operation piece 8 is formed as a flexible frame member having a flexible displacement allowing space Sc between flexible deformation frame portions 8*a* and 8*b* provided so as to oppose to each other at the upper and lower portions.

As shown in FIGS. 22 and 25, at the opposite side to the flexible displacement allowing space Sc in the pair of the flexible deformation frame portions 8*a* and 8*b* of the operation piece 8, a mountain-shaped provisional engagement projection 8*a*' having a tapered engagement guide portion 8*a*1' and a vertical engagement portion 8*a*2' is formed at the upper portion of the upper side flexible deformation frame portion 8*a*, and a regular engagement projection 8*b*' having a tapered engagement guide portion 8*b*1' and a vertical engagement portion 8*b*2' is formed at the lower portion of the lower side flexible deformation frame portion 8*b*.

At each of side wall outer surfaces 9*a* (FIG. 22) of the body A1, a mountain-shaped provisional engagement projection Ra and a mountain-shaped regular engagement projection Rb are protrusively provided at the one and the other of the opposed inner sides of a pair of guide ribs R which are provided with a space therebetween so as to receive the operation piece 8 therein.

A supporting portion 8*c* (FIG. 25) erected outward is provided at the free end portion of the operation piece 8. A movable arm 8*e* extending in parallel to the operation piece 8 at the outside of the operation piece 8 is provided at the supporting portion 8*c*. An operation portion 8*d* extended over the supporting portion 8*c* is provided at the movable arm 8*e*. A deformation prevention projection 8*f* is protrusively provided at the free end of the movable arm 8*e* so as to proceed within the flexible displacement allowing space Sc to prevent the elastic deformation of the flexible deformation frame portions 8*a*, 8*b*.

In the aforesaid configuration, the operation piece 8 is operated in a manner that the main frame portion 6 is inserted within the hood portion A2 while being slidably made in contact with the inner portion of the hood portion A2, and the pair of the pieces 8 are advanced into the space between the pair of the guide ribs R, R at the side wall outer surfaces 9*a* of the housing main body portion A1 from the windows WD of the step portions A3, respectively. Simultaneously, as shown in FIG. 23A, the operation portion 8*d* is held to draw out the operation piece 8 while flexibly displacing the operation piece outward and the operation piece 8 is restored when the provisional engagement projection 8*a*' moves over the provisional engagement projection Ra of the guide rib R thereby to engage the provisional engagement projection 8*a*' with the provisional engagement projection Ra. In this manner, the terminal metal member insertion detecting member B is held at the provisional engagement position with respect to the connector A.

As shown in FIG. 23B, at the provisional engagement position, the terminal metal member C is inserted within the terminal housing chamber 1 from the rear direction of the body A1. In this case, the terminal metal member C is inserted while displacing the flexible engaging piece 3 through the flexible displacement allowing space 4, and the engaging projection 3*b* of the flexible engaging piece 3 having been restored is engaged with the shoulder portion SD of the terminal metal member C at when the insertion of the terminal metal member C is completed.

In the provisional engagement position, since a deformation prevention projection 8*f* is positioned within the flexible displacement allowing space Sc, the deformation of the flexible deformation frame portions 8*a* and 8*b* can be prevented by the deformation prevention projection 8*f*. In this manner, such a phenomenon can be surely prevented from occurring that when an external force is applied to the main frame portion 6, the regular engagement projection 8*b*' is displaced by the elastic deformation of the flexible deformation frame portion 8*b* and moves over the regular engagement projection Rb and so the insertion detection member inadvertently shifts to a regular engagement position.

In the case of shifting the terminal metal member insertion detecting member B from the provisional engagement state to the regular engagement state, as shown in FIG. 25, the operation portion 8*d* is pushed in the outer surface direction of the side wall thereof thereby to displace the movable arm 8*e* outward around the erected supporting portion 8*c* serving as a fulcrum, whereby the deformation prevention projection 8*f* is moved backward from the position within the flexible displacement allowing space Sc.

When the operation portion 8*d* is withdrawn in this state, as shown in FIG. 24A, the regular engagement projection 8*b*' moves over the regular engagement projection Rb while displacing together with the flexible deformation frame portion 8*b* and shifts to the regular engagement position. As shown in FIG. 24B, in the regular engagement position, the insertion detecting body 7 moves into the flexible displacement allowing space 4 to prevent the displacement of the flexible engaging piece 3, so that the terminal metal member C can be surely prevented from moving out of the terminal housing chamber.

When the terminal metal member C is in an incomplete insertion state, since the flexible engaging piece 3 is positioned within the flexible displacement allowing space 4, the insertion detecting body 7 can not move into the flexible displacement allowing space 4. Thus, the terminal metal member insertion detecting member B can not move to the regular engagement position and so the incomplete insertion of the terminal metal member C can be detected. In the case of returning the insertion detecting member from the regular engagement position (FIG. 24A) to the provisional engagement position (FIG. 23A), the operation portion 8*d* is pushed in the aforesaid manner to move the deformation prevention projection 8*f* from the position between the flexible deformation frame portions 8*a*, 8*b*, whereby the insertion detecting member can be moved.

In this manner, the terminal metal member insertion detecting member B, that is, the holder B constituting the connector with the aforesaid structure is provided at the connector so as to attain the double engagement. The regular engagement and the release of the regular engagement are performed by using the hands.

The double engagement will be explained. The engaging state of a normal terminal is performed in a manner that the terminal is engaged within the terminal housing chamber of the connector housing by a lance or an arm made of plastics. The double engagement system is performed in a manner that, in order to improve the holding force of the terminal within the terminal housing chamber of the connector housing, the terminal is engaged with the connector housing in a duplex manner by another part such as a spacer etc. The lance means a lance shaped thing, but the engagement lance is not limited to one of a lance shape and there are various types of lances such as one of an arm shape etc.

However, in the aforesaid conventional connector, it was feared that the holder B may be forgotten to be regularly engaged with the housing main body portion A1 or that the movable arm 8*e* of only one of the pieces 8 is drawn and so a complete regular engagement is not performed but an unfinished engagement state or a half engagement is performed or an unfinished fitting state or a half fitting is performed.

Further, since the movable arm 8*e* is exposed outside of the connector housing even after the holder B is regularly engaged with the connector A, when an external force is applied to the movable arm 8*e*, the operation piece 8 including the movable arm 8*e* is elastically deformed. Thus, it was also feared that the operation piece 8 may not be returned from the regular engagement state to the provisional engagement state.

SUMMARY OF THE INVENTION

In view of the aforesaid problem, an object of the invention is to provide the coupling structure for connectors with holders in which a holder such as a front holder can be prevented from being engaged with a connector housing in an unfinished state, and a holder regularly engaged with the connector housing does not deform even when external force is applied to a connector and so the holder can be restored to a regular engagement state from a provisional engagement state.

(1) In order to attain the aforesaid object, the coupling structure for connectors with holders of the invention is characterized in that a connector coupling structure comprising:

a first connector including a first connector housing, a first terminal accommodated in the first connector housing, a holder for holding the terminal, and a first spacer accommodated in the first connector housing for doubly engaging the terminal; and a second connector including a second connector housing and a second terminal accommodated in the second connector housing; wherein when a front surface of the second connector pushes with pressure a front surface of the holder housed within the first connector housing for fitting the first connector and the second connector, the holder is regularly engaged with the first connector housing and simultaneously the first terminal is coupled to the second terminal.

According to the aforesaid configuration, the regular engagement between the one connector and the one connector housing can be performed simultaneously with the coupling between the terminal of the one connector and the other terminal of the other connector. Thus, the operation feeling at the time of performing the fitting operation between the one connector and the other connector can be improved. Since the regular engagement of the holder is performed by the fitting operation between the connectors, the so-called male-female fitting operation of two-step feeling, in which the regular engagement between the connector housing and the holder is performed separately from the coupling between the terminal of the one connector and the terminal of the other connector. Therefore, it is possible to prevent the occurrence of such a trouble state of the unfinished engagement state, that is, the half engagement state or the unfinished fitting state, that is, the half fitting state of the holder which is feared to be occurred at the time of coupling the connectors.

(2) The connector coupling structure according to (1), wherein a flexible arm portion is provided on the holder and an arm housing portion is provided within the first connector housing along a longitudinal direction of the arm portion, and the arm portion is slidable on the arm housing portion along a longitudinal direction thereof.

According to the aforesaid configuration, since the flexible arm portion provided at the holder is protected by the arm housing portion within the one connector housing, the flexible arm portion of the holder is prevented from being exposed outside of the one connector housing. Thus, it is possible to prevent the occurrence of such a trouble that other member hits against the flexible holder to cause plastic deformation at the flexible holder and so the holder regularly engaged with the one connector housing can not be restored to the provisional engagement state.

(3) The connector coupling structure according to (2), wherein the arm portion of the holder is provided with a flexible space, a provisional stop portion and a regular stop portion, and the arm housing portion of the first connector housing is provided with an arm housing chamber formed by a top wall, a separation wall and a pair of side walls arranged in an enclosure manner, a provisional engagement portion formed by one of the side walls in correspondence with the provisional stop portion and a regular engagement portion formed by the other of the side walls in correspondence with the regular stop portion.

According to the aforesaid configuration, since the flexible arm portion of the holder can be easily maintained at the provisional engagement state and also can be easily maintained at the regular engagement state within the arm housing chamber of the one connector housing. Thus, it is possible to prevent the occurrence of such a trouble that the holder is separated from the one connector housing to be gotten lost and so the terminal provided within the one connector housing is not protected by the holder.

(4) The connector coupling structure according to (1) to (3), wherein a pair of introducing portions are formed at the holder, and a pair of guide portions are formed in the first connector housing.

According to the aforesaid configuration, when the holder is housed within the one connector housing, the holder can be easily and quickly housed within the one connector housing at the predetermined posture without being broken. Further, the arm portion of the holder can be easily and quickly introduced within the arm housing portion of the one connector housing formed along the longitudinal direction of the arm portion.

(5) The connector coupling structure according to (1) to (4), wherein the second connector housing is provided with a second spacer for doubly engaging the second terminal and a second front holder which protects or holds the second terminal and is made abut against the first holder.

According to the aforesaid configuration, the other connector housing constituting the other connector and the holder are formed separately. Thus, the members with complicated configurations provided within the other connector housing can be formed easily, and further the other terminal provided at the other connector housing is protected by the front holder. Further, the other terminal provided within the other connector housing is doubly engaged by the other spacer and so the other terminal can be surely attached to the other connector housing.

BRIEF DESCRIPTION OF THE DRAWINGS

FIG. 20A is an explanatory diagram at the time of fitting only a retaining lock portion and an engagement locking portion, FIG. 20B is an explanatory diagram at the time of fitting only the holder and the connector housing, FIG. 20C is an explanatory diagram at the time of fitting only the male terminal and the female terminal, and FIG. 20D is an explanatory diagram at the time of fitting only the one connector and the other connector;

DETAILED DESCRIPTION OF THE PREFERRED EMBODIMENTS

An embodiment of a connector with holders according to the invention will be explained with reference to the drawings.

Figure 1:
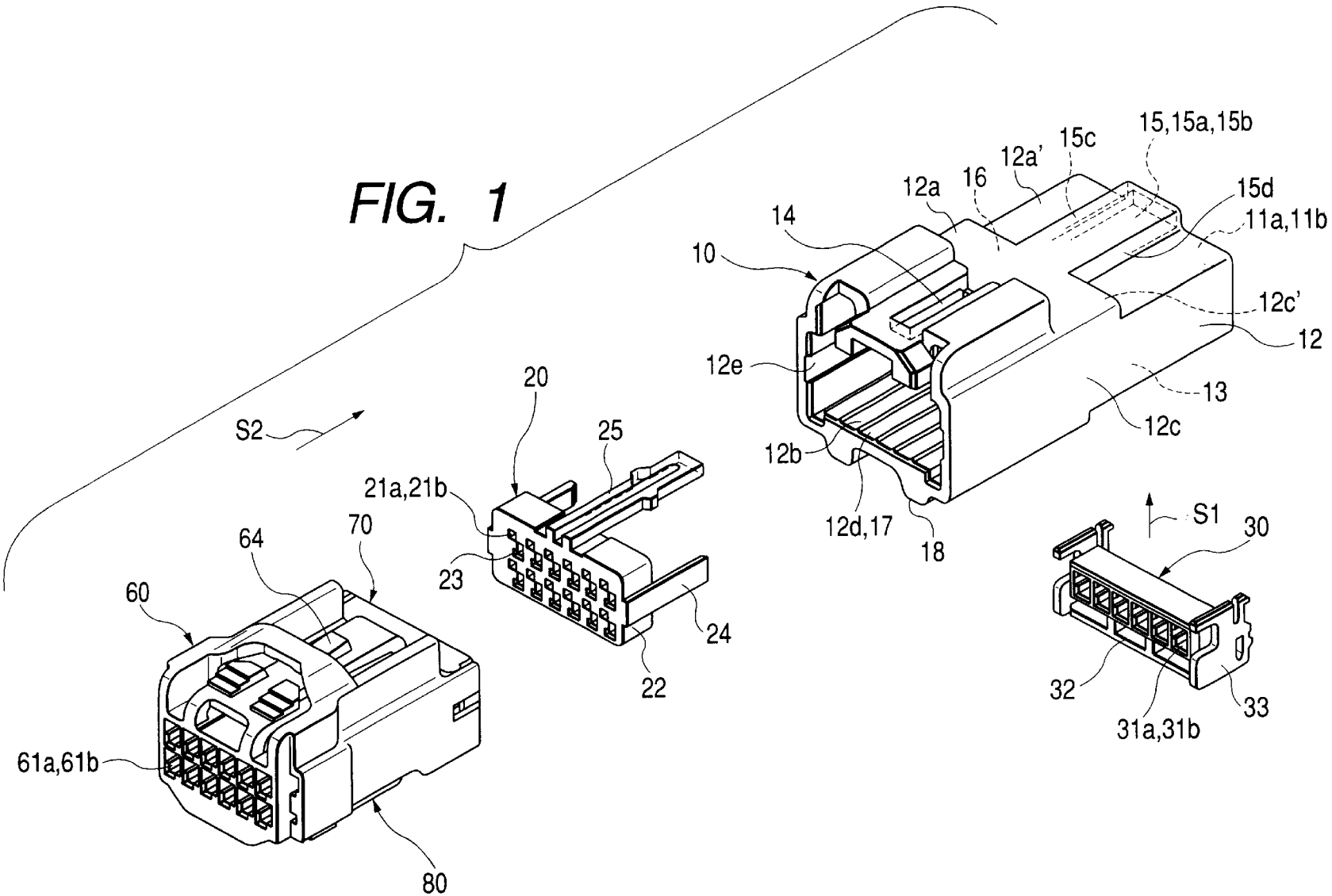
FIG. 1 is an exploded perspective view showing the embodiment of the connector with holders according to the invention.
Figure 2:
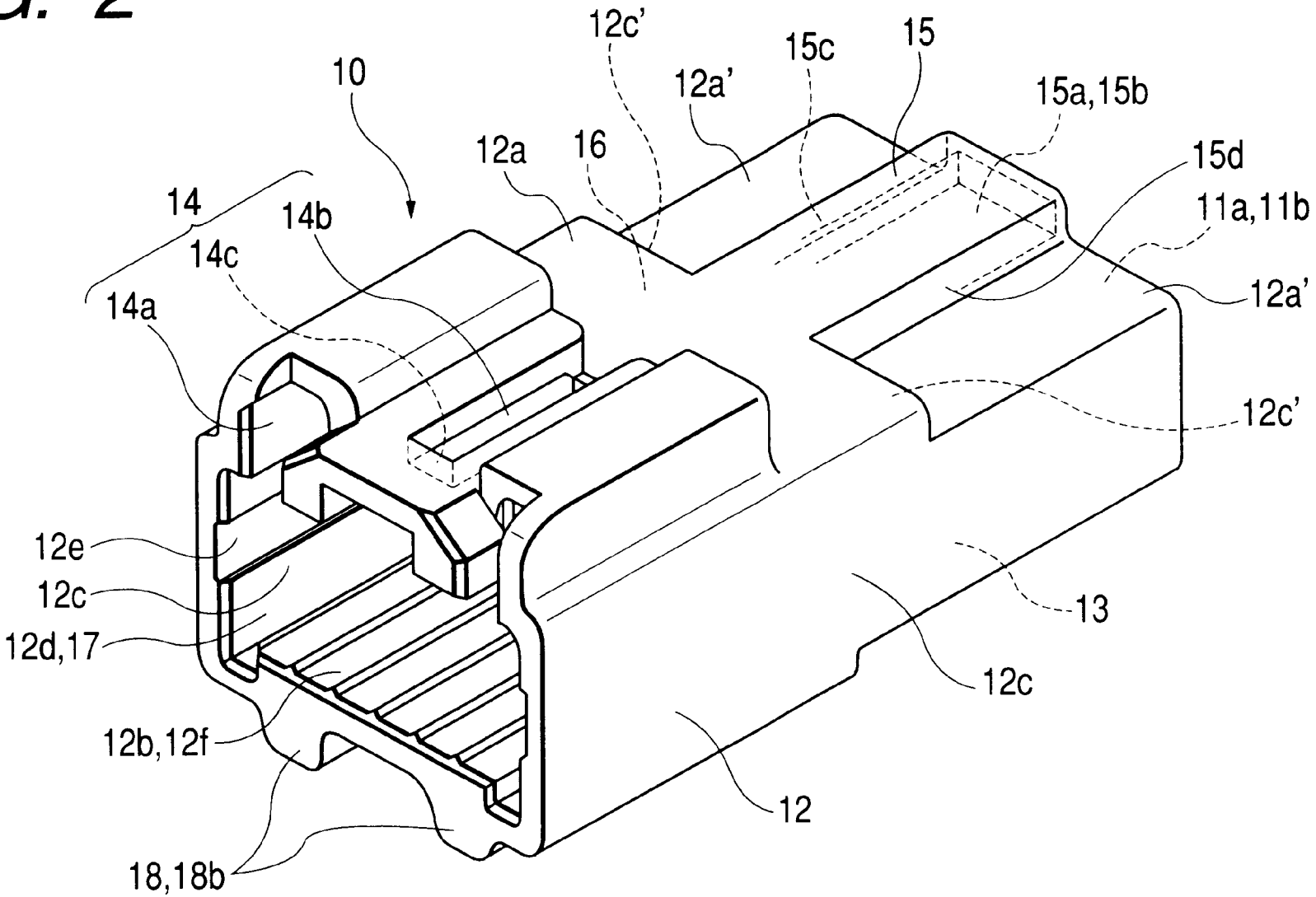
FIG. 2 is a perspective view showing a connector housing.
Figure 3:
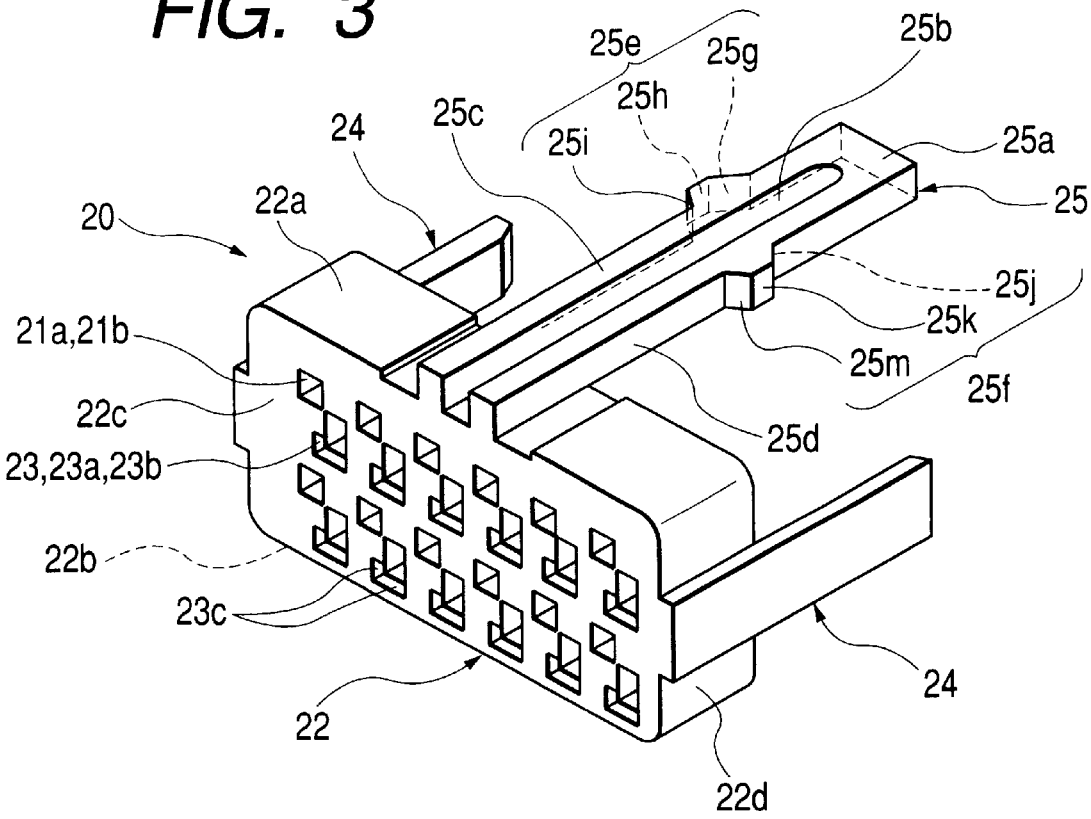
FIG. 3 is a perspective view showing a holder.
Figure 4:
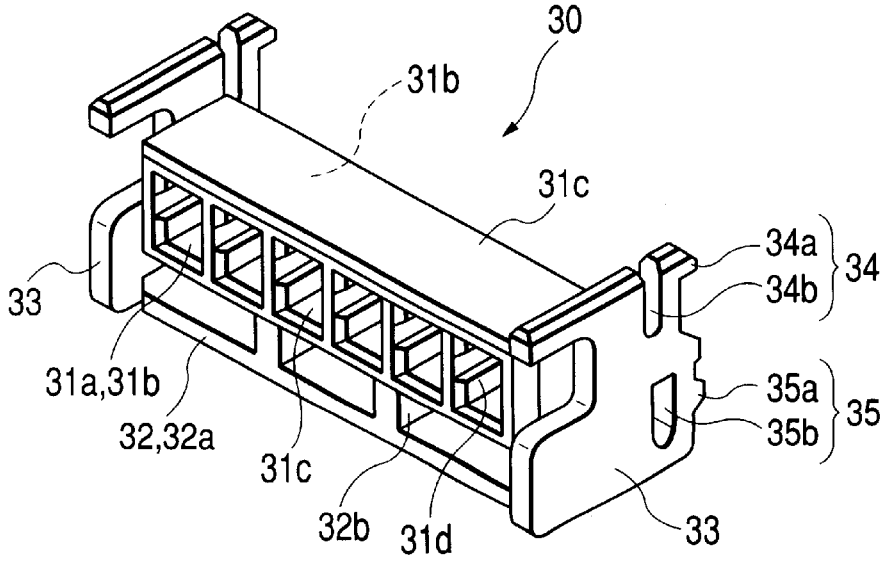
FIG. 4 is a perspective view showing a spacer.
Figure 5:
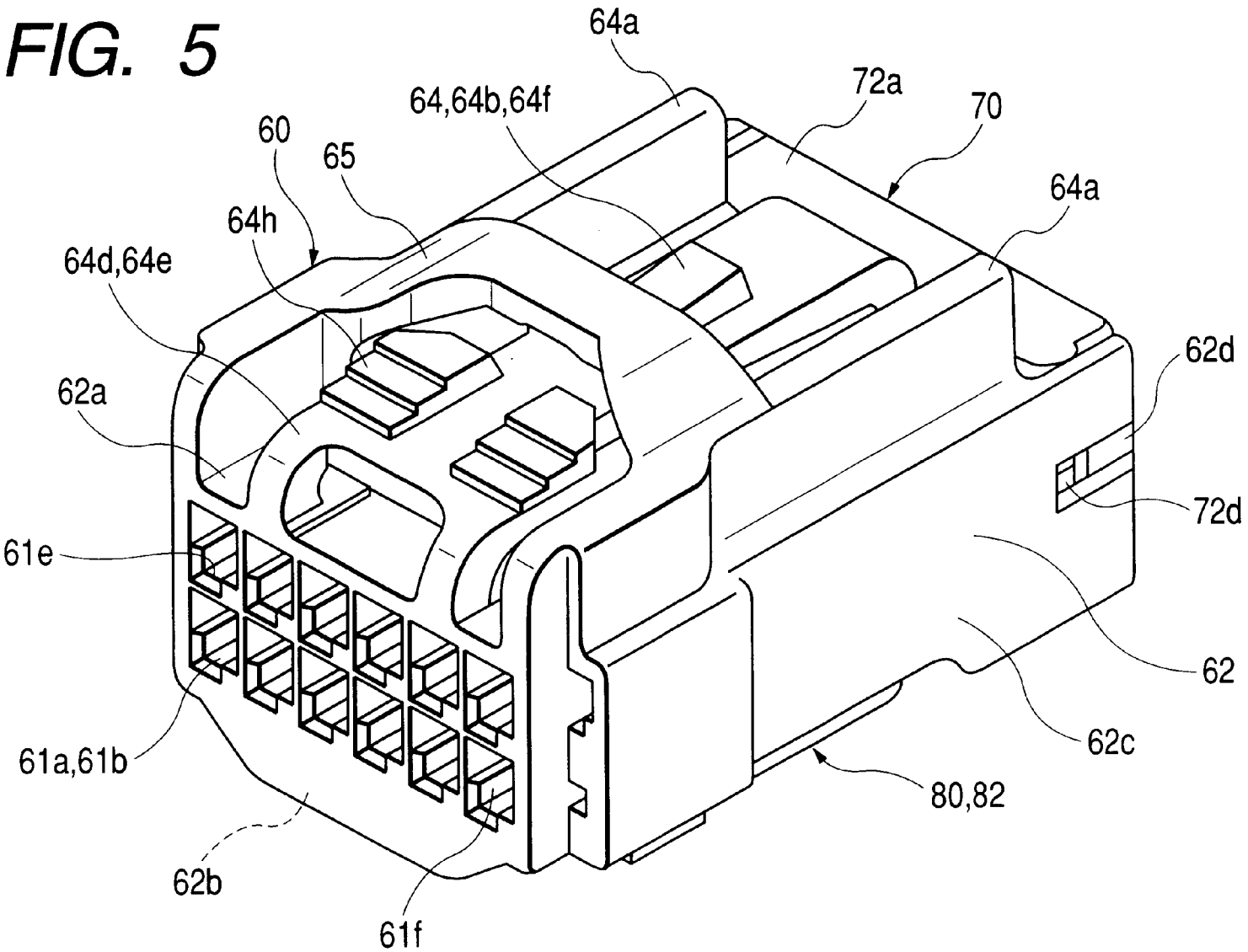
FIG. 5 is a perspective view showing a state where a front holder and another spacer are assembled with another connector housing.

FIG. 1 is an exploded perspective view showing the embodiment of the connector with holders according to the invention. FIG. 2 is a perspective view showing a connector housing, FIG. 3 is a perspective view showing a front holder, FIG. 4 is a perspective view showing a spacer, FIG. 5 is a perspective view showing a state where another front holder and another spacer are assembled with another connector housing.

Figure 6:
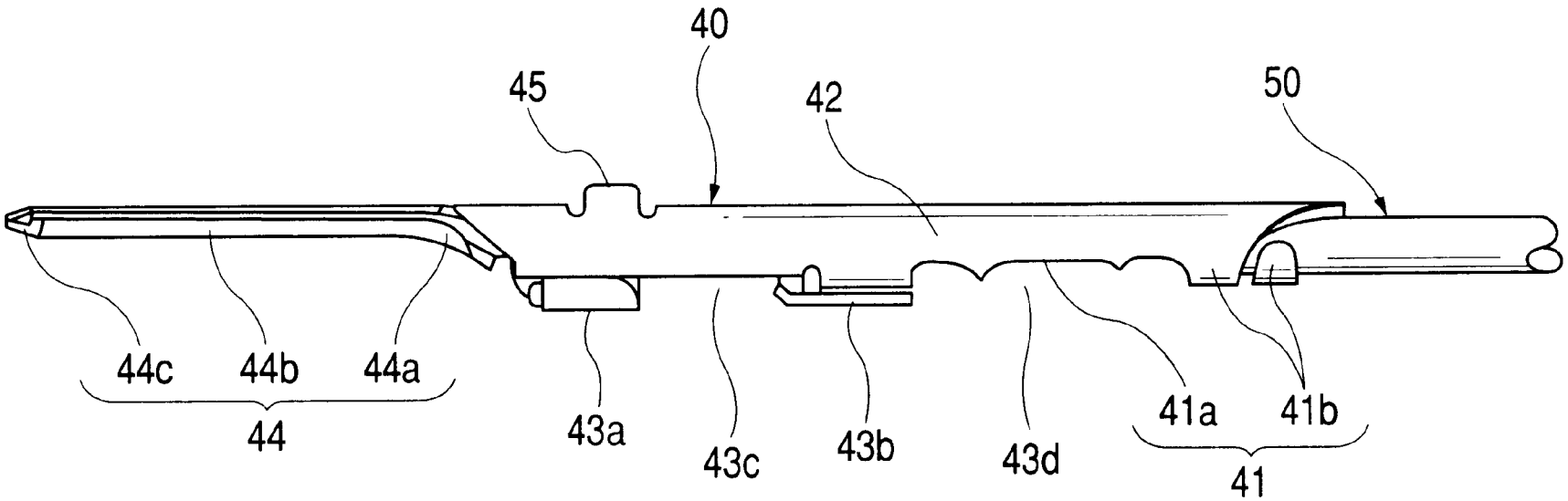
FIG. 6 is a side view showing an assembled state of a male terminal and an electric wire.
Figure 7A:
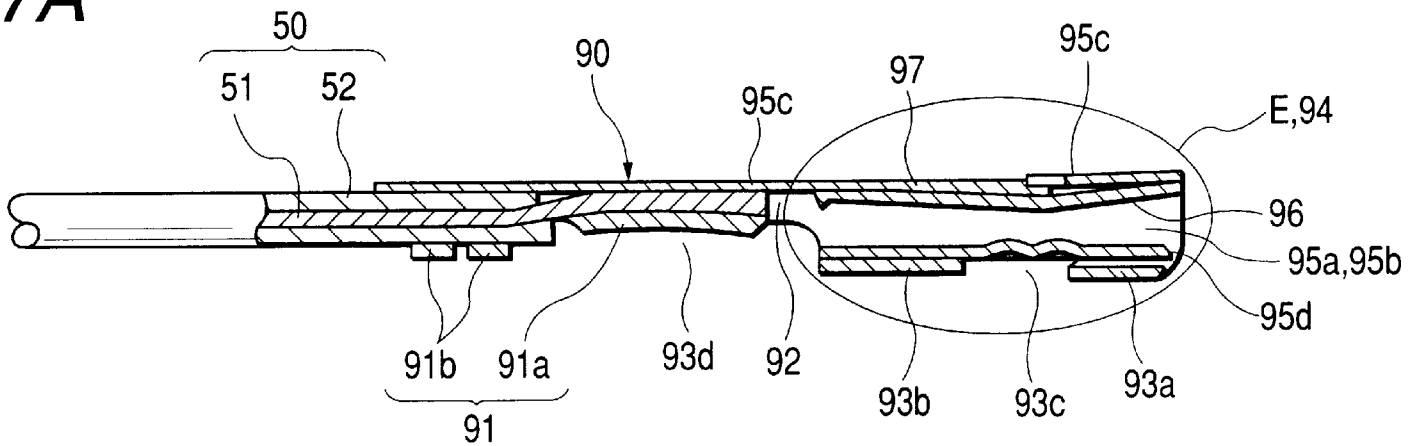
FIG. 7A is a longitudinal sectional view showing an assembled state of a female terminal and an electric wire.
Figure 7B:
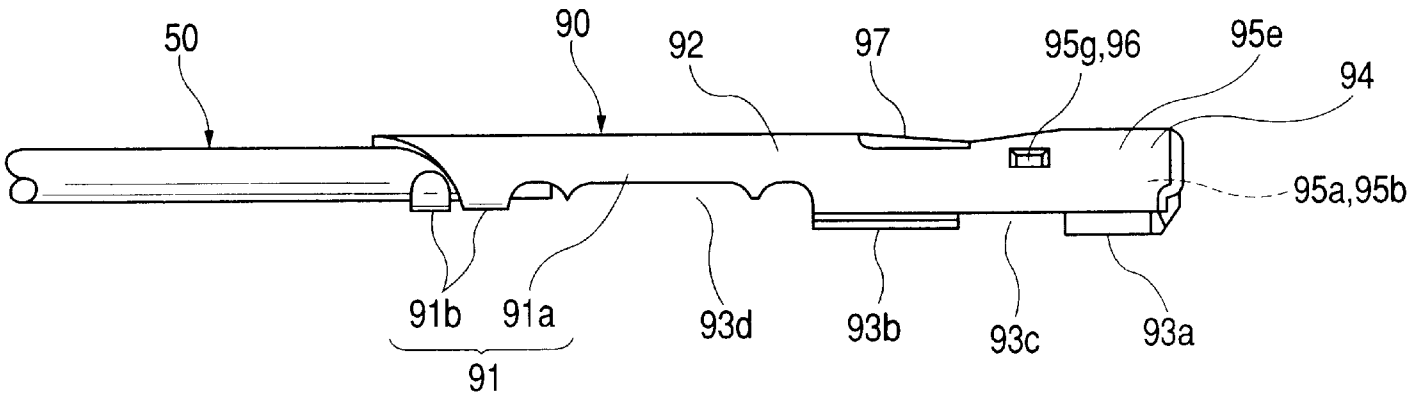
FIG. 7B is a side view showing the assembled state of the female terminal and the electric wire.
Figure 8:
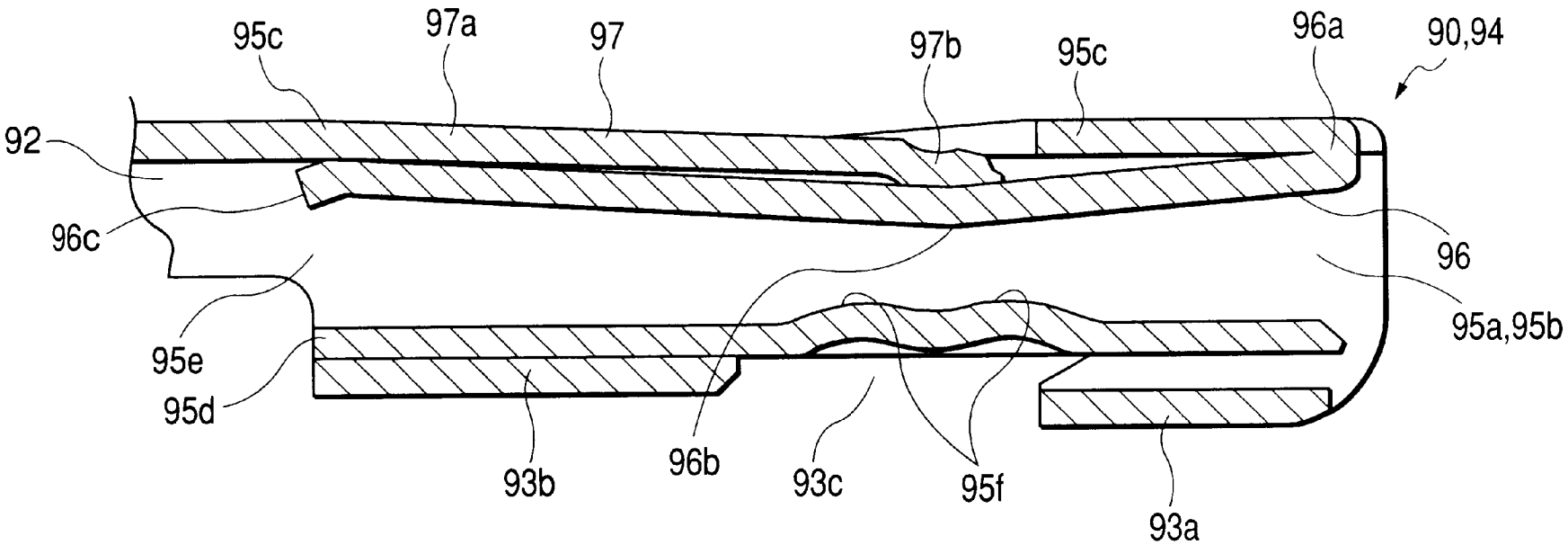
FIG. 8 is an enlarged explanatory diagram showing a portion E in FIG. 7A.

FIG. 6 is a side view showing an assembled state of a male terminal and an electric wire, FIG. 7A is a longitudinal sectional view showing an assembled state of a female terminal and an electric wire, FIG. 7B is a side view showing the assembled state of the female terminal and the electric wire, and FIG. 8 is an enlarged explanatory diagram showing a portion E in FIG. 7A.

Figure 9:
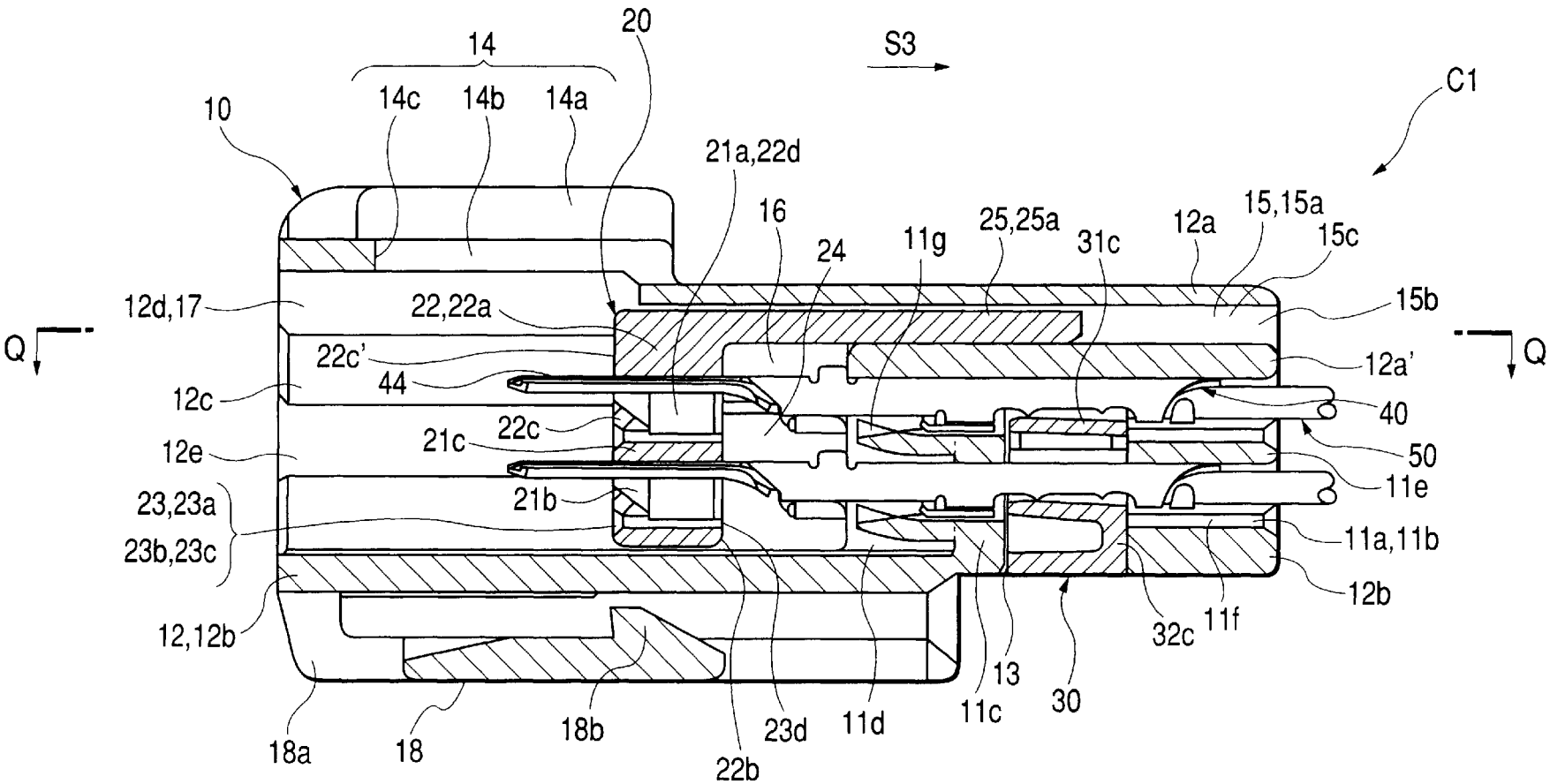
FIG. 9 is a longitudinal sectional view showing a state where the holder is provisionally engaged with the connector housing.
Figure 10:
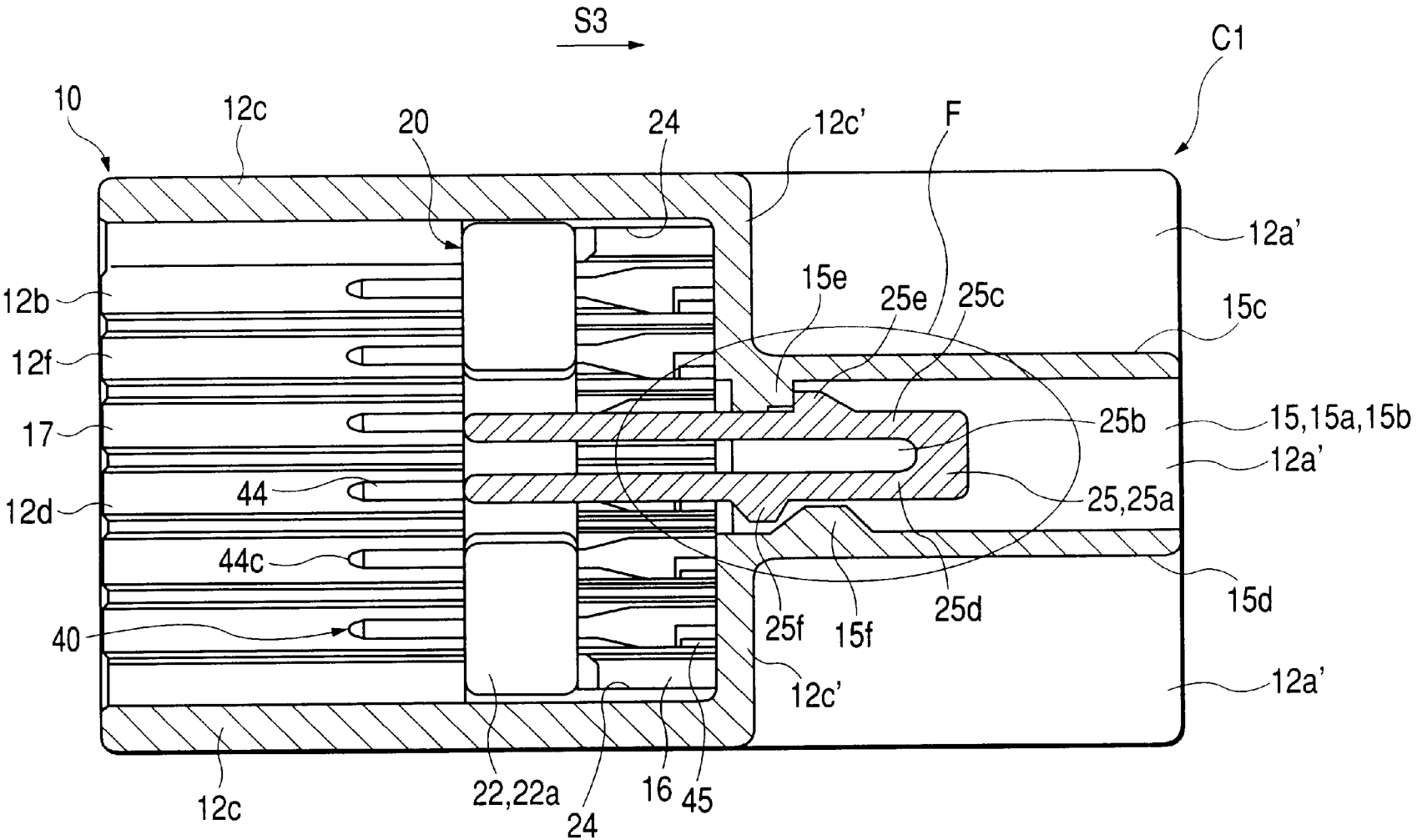
FIG. 10 is a sectional view along a line Q—Q in FIG. 9.
Figure 11:
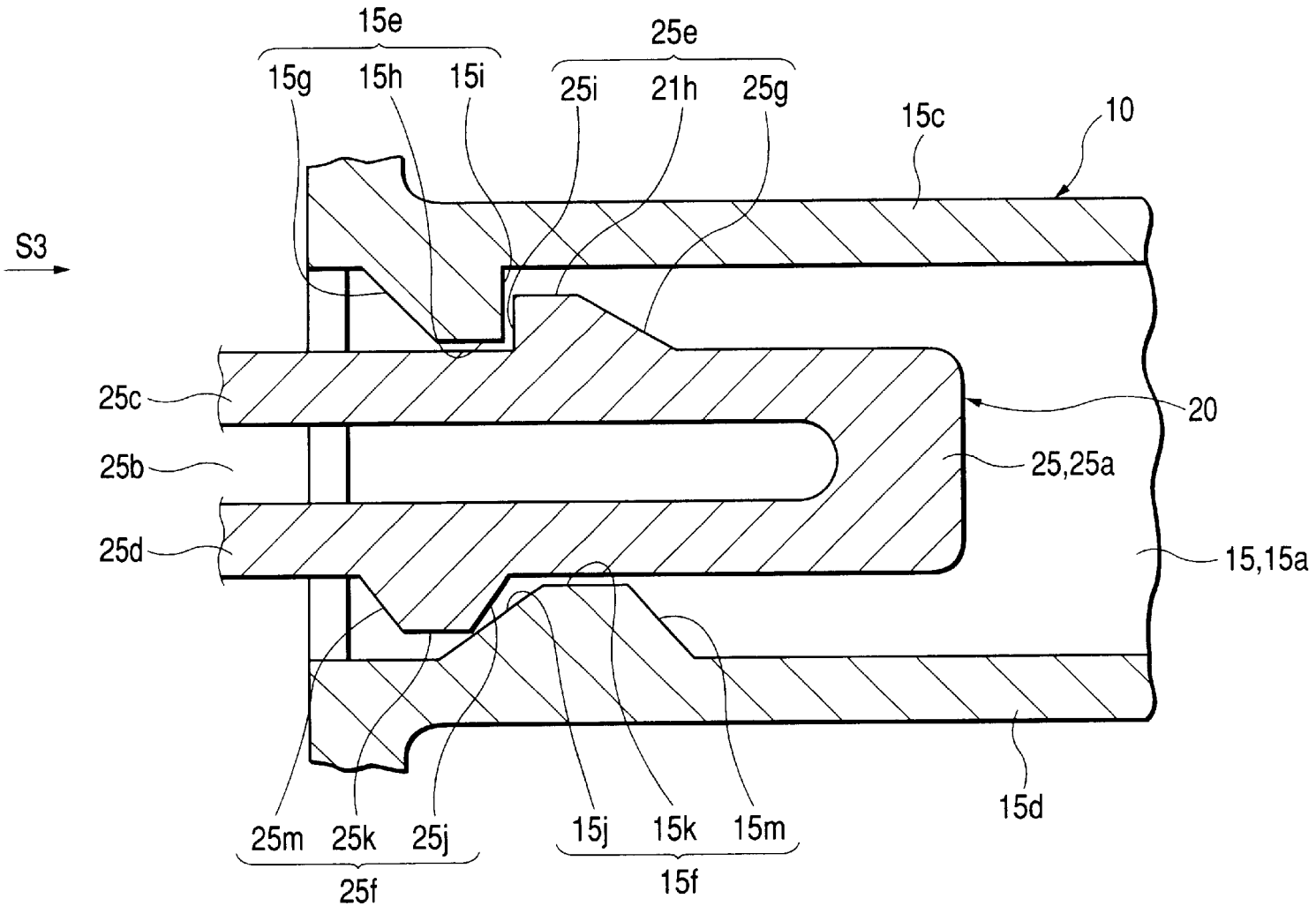
FIG. 11 is an enlarged explanatory diagram showing a portion F in FIG. 10.
Figure 12:
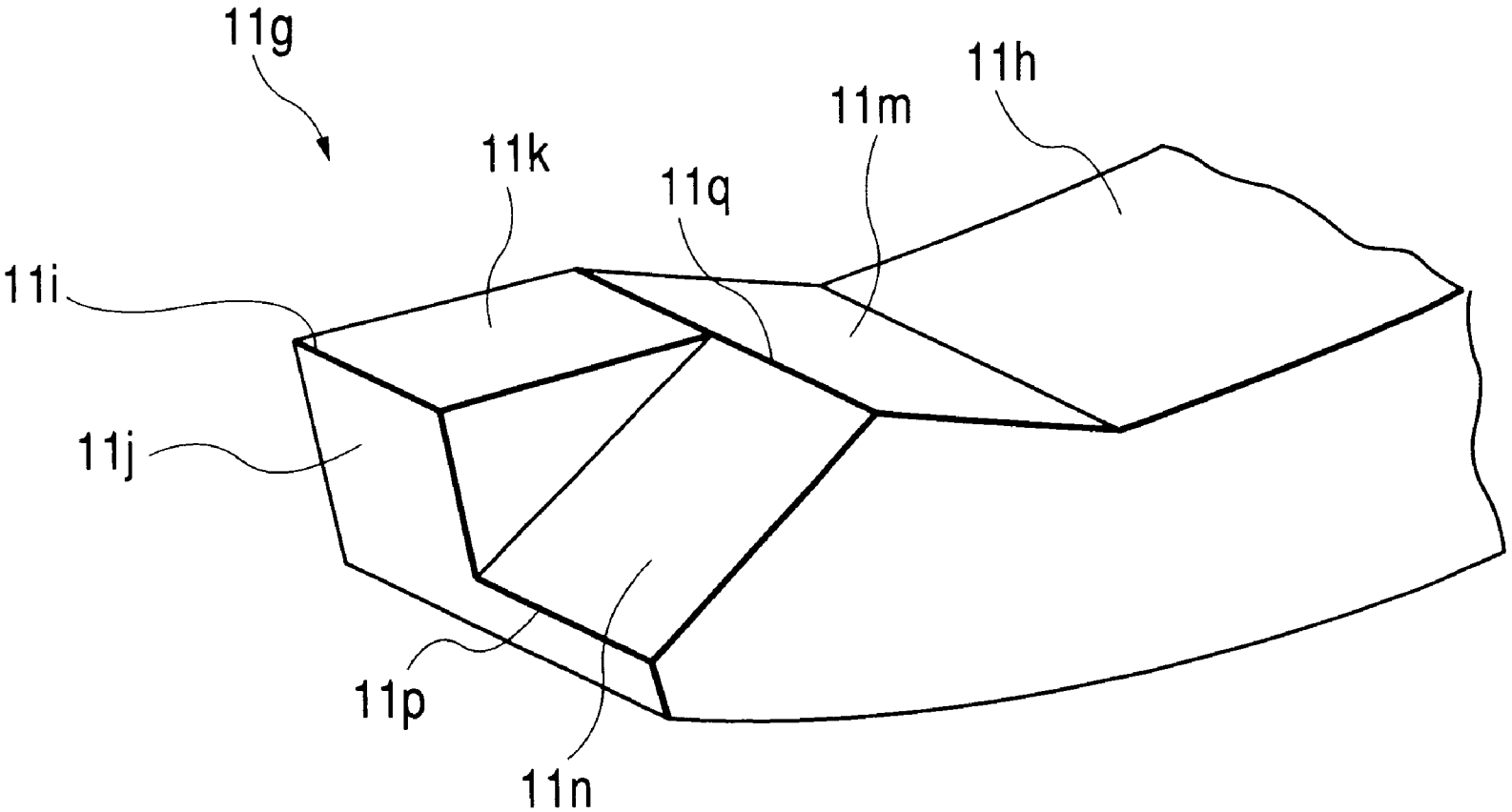
FIG. 12 is a perspective view showing an engagement lance.
Figure 13:
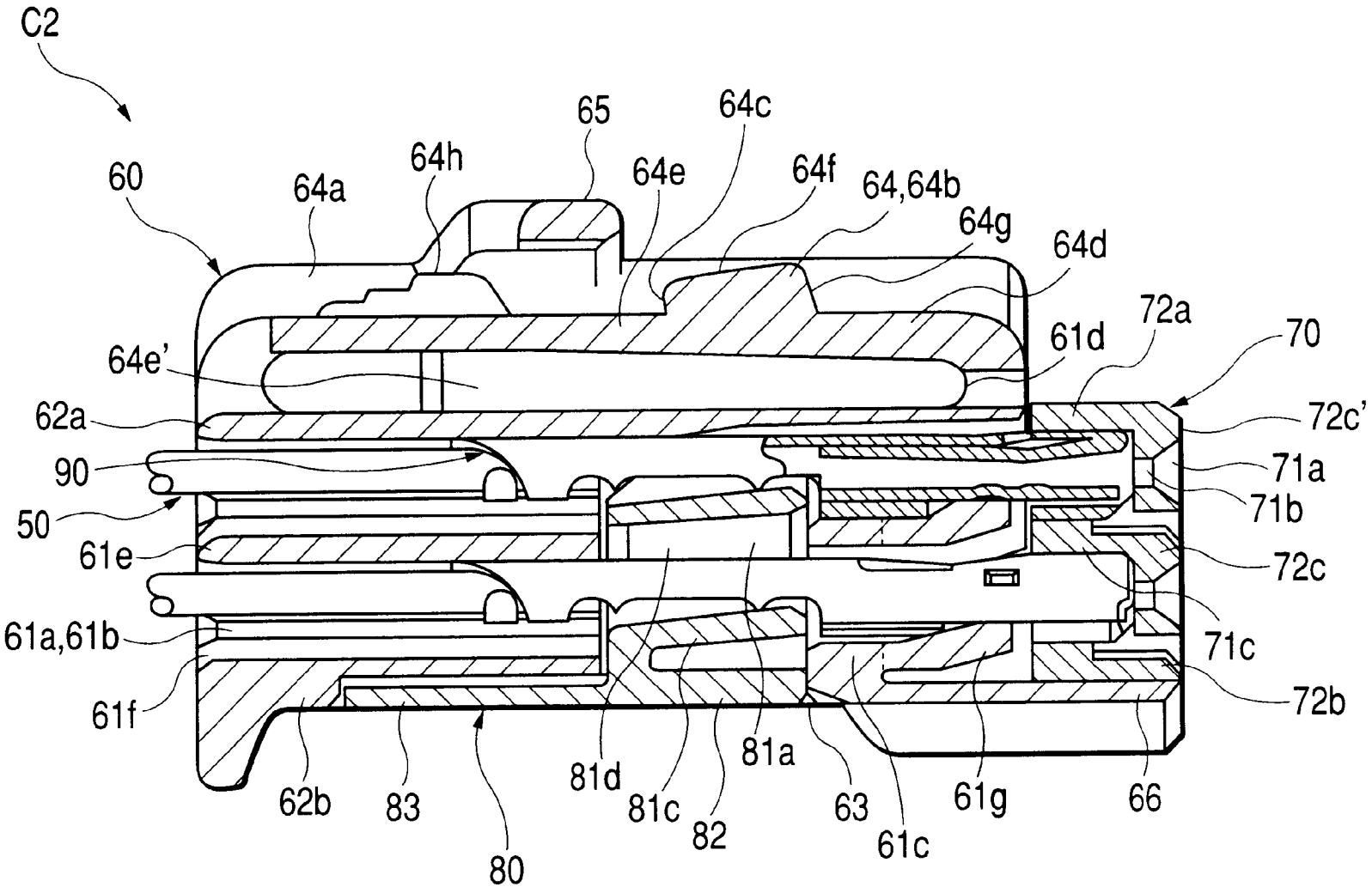
FIG. 13 is a longitudinal sectional view showing the other connector.

FIG. 9 is a longitudinal sectional view showing a state where the front holder is provisionally engaged with the connector housing, FIG. 10 is a sectional view along a line Q—Q in FIG. 9, FIG. 11 is an enlarged explanatory diagram showing a portion F in FIG. 10, FIG. 12 is a perspective view showing an engagement lance, and FIG. 13 is a longitudinal sectional view showing the other connector.

Figure 14:
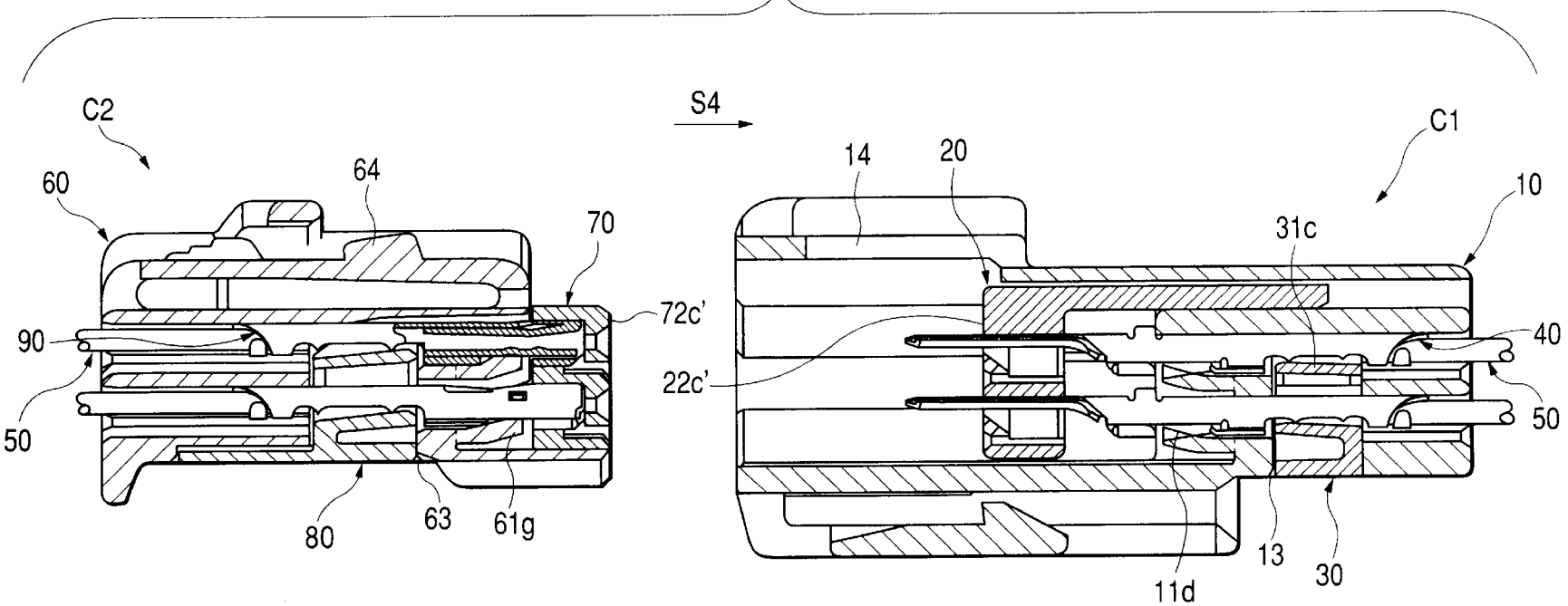
FIG. 14 is a longitudinal sectional view showing a state before the start of the fitting operation between one connector and the other connector.
Figure 15:
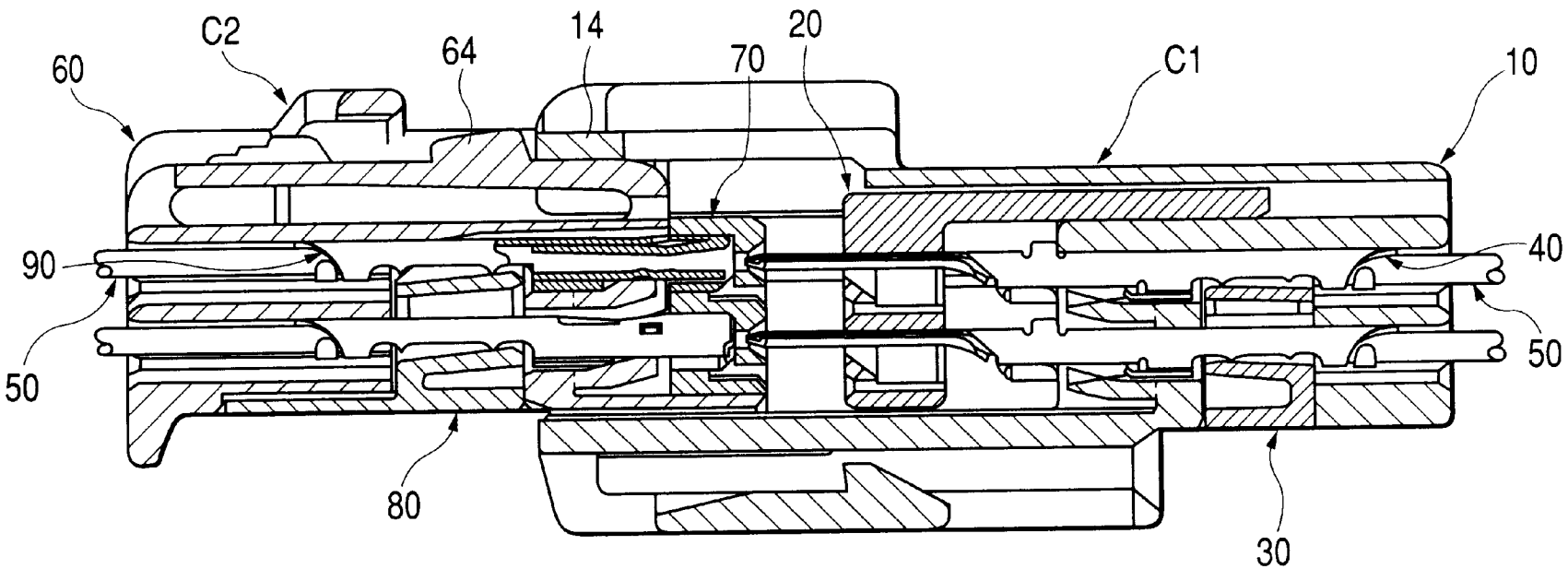
FIG. 15 is a longitudinal sectional view showing a state where the fitting operation between the one connector and the other connector has started.
Figure 16:
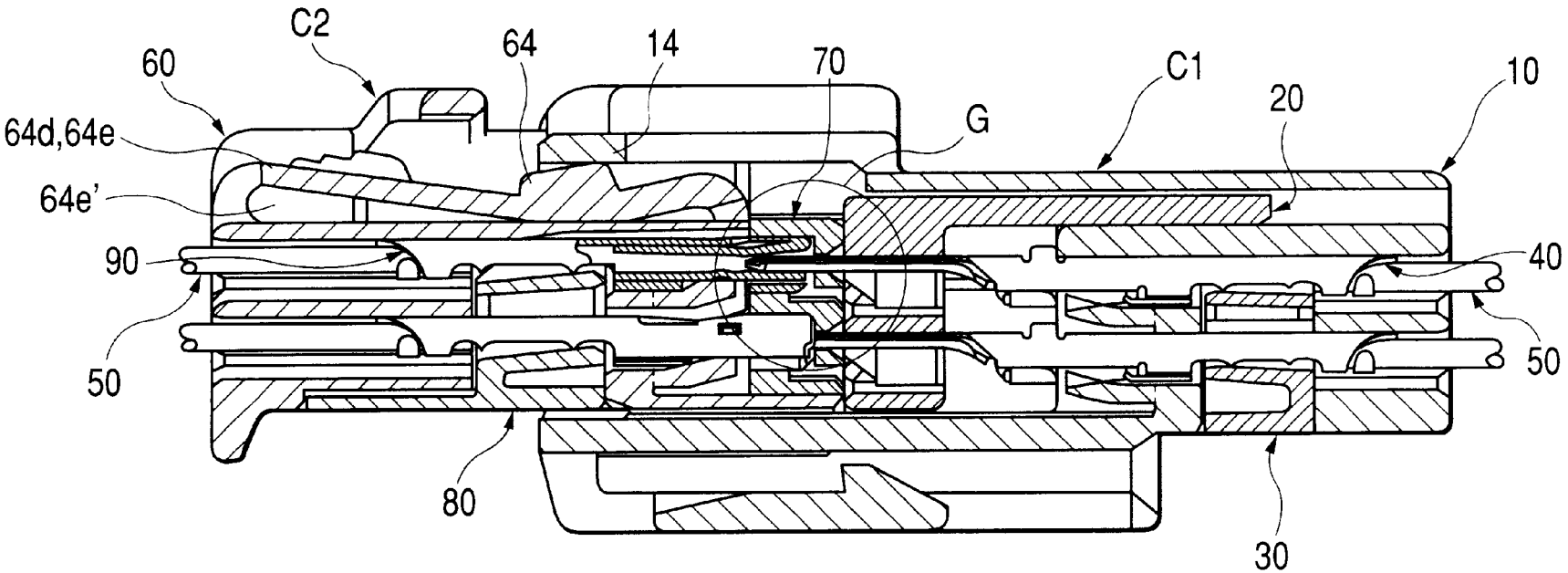
FIG. 16 is a longitudinal sectional view showing a state where the fitting operation between the one connector and the other connector is being performed.
Figure 17:
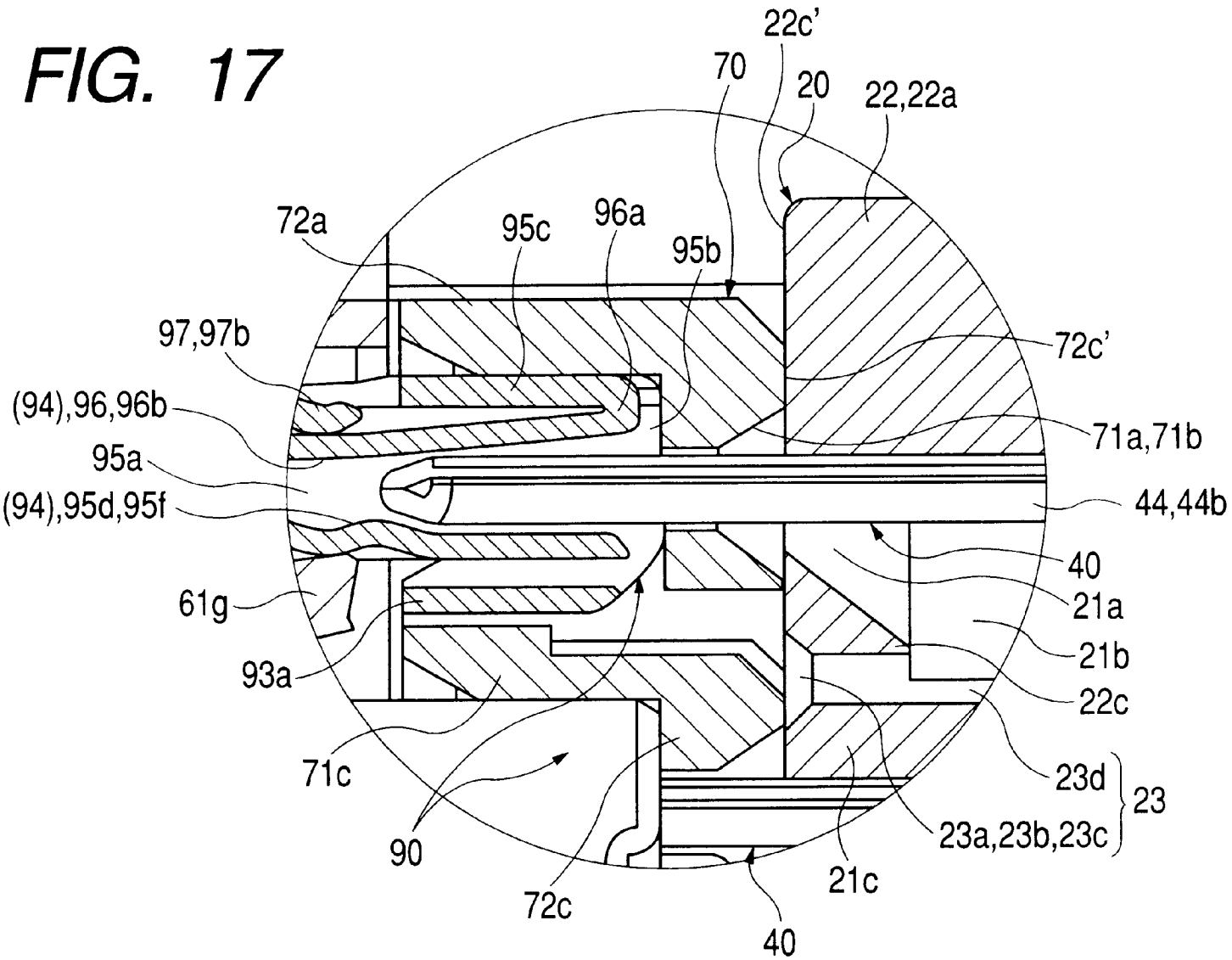
FIG. 17 is an enlarged explanatory diagram showing a portion G in FIG. 16.
Figure 18:
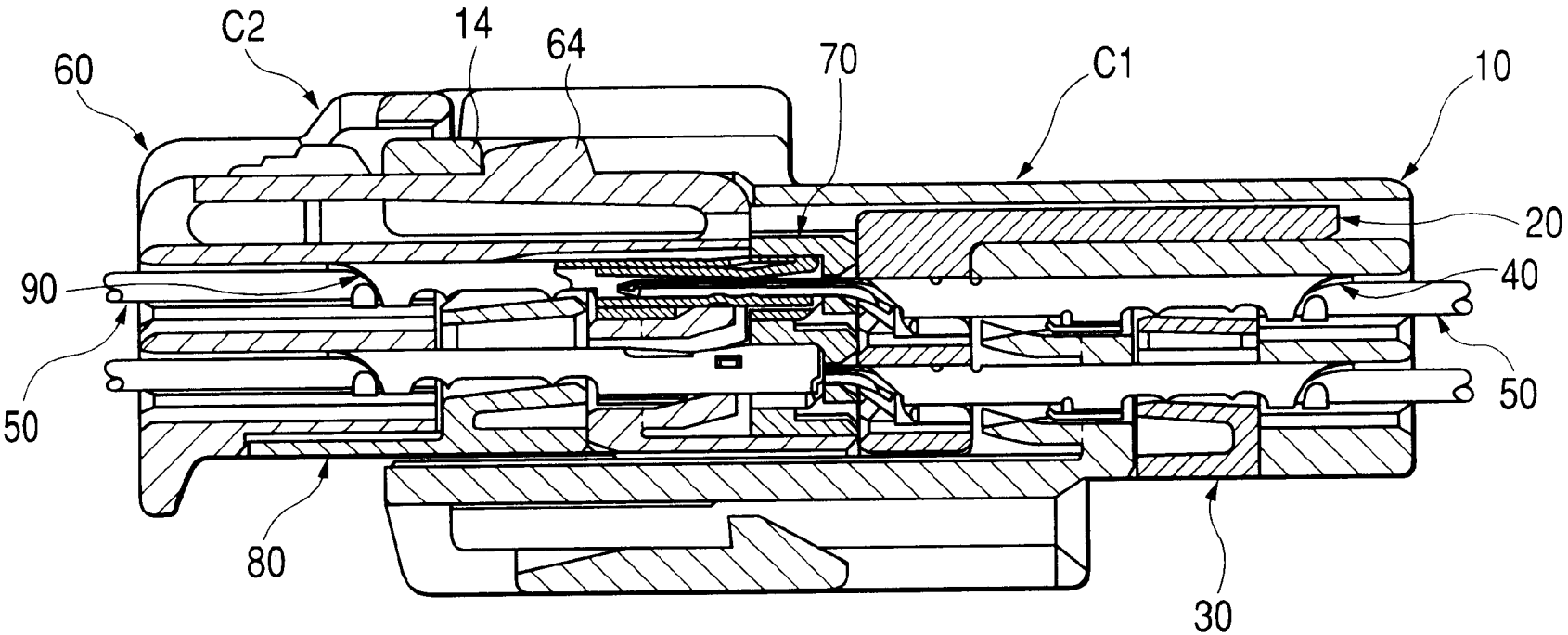
FIG. 18 is a longitudinal sectional view showing a state where the fitting operation between the one connector and the other connector has finished.

FIG. 14 is a longitudinal sectional view showing a state before the start of the fitting operation between one connector and the other connector, FIG. 15 is a longitudinal sectional view showing a state where the fitting operation between the one connector and the other connector has started, FIG. 16 is a longitudinal sectional view showing a state where the fitting operation between the one connector and the other connector is being performed, and FIG. 17 is an enlarged explanatory diagram showing a portion G in FIG. 16, and FIG. 18 is a longitudinal sectional view showing a state where the fitting operation between the one connector and the other connector has finished.

Figure 19:
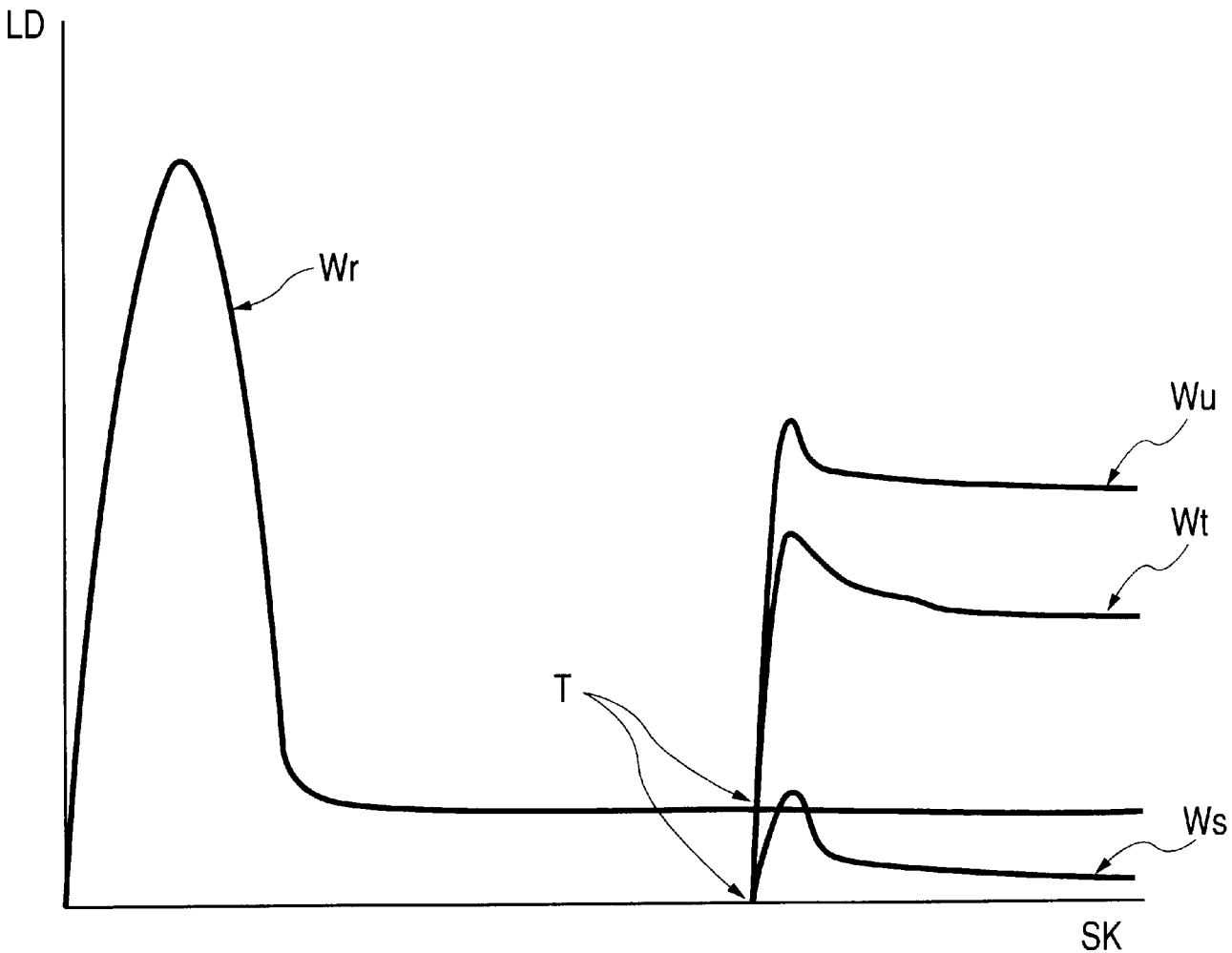
FIG. 19 is an explanatory diagram showing a relation between a stroke and a load at the time of fitting the connector with holders.
Figure 20A:
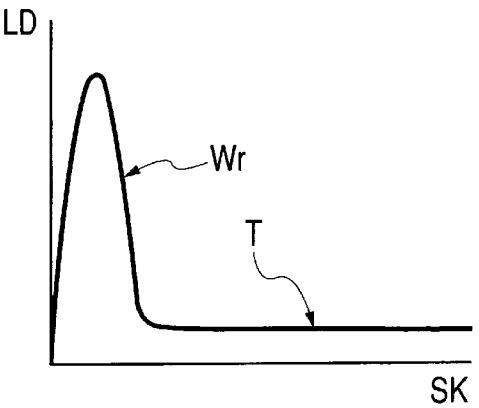
FIGS. 20A through 20D is an explanatory diagram also showing the relation between a stroke and a load.
Figure 20B:
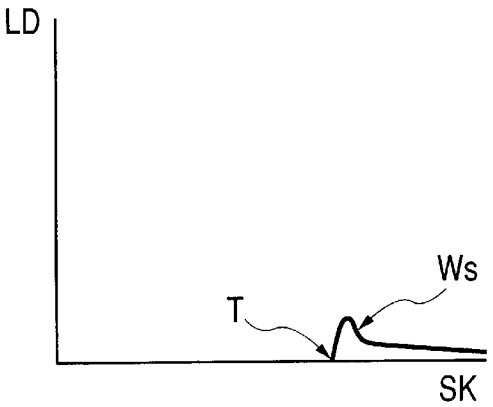
Figure 20C:
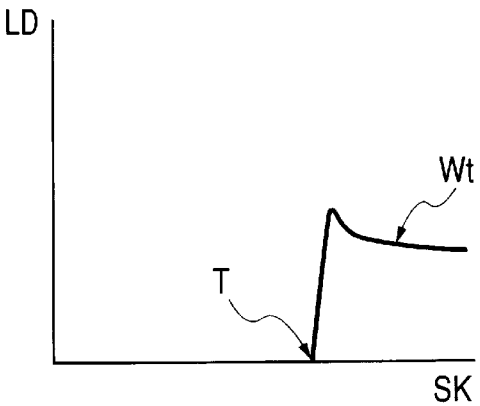
Figure 20D:
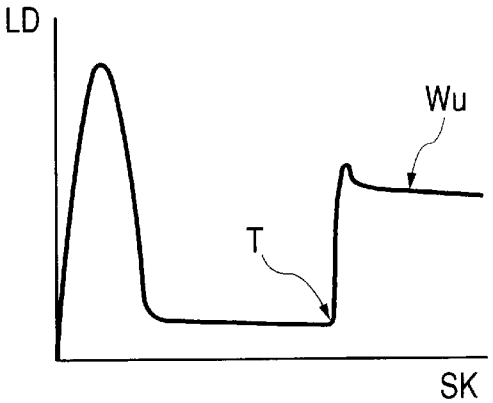
Figure 21:
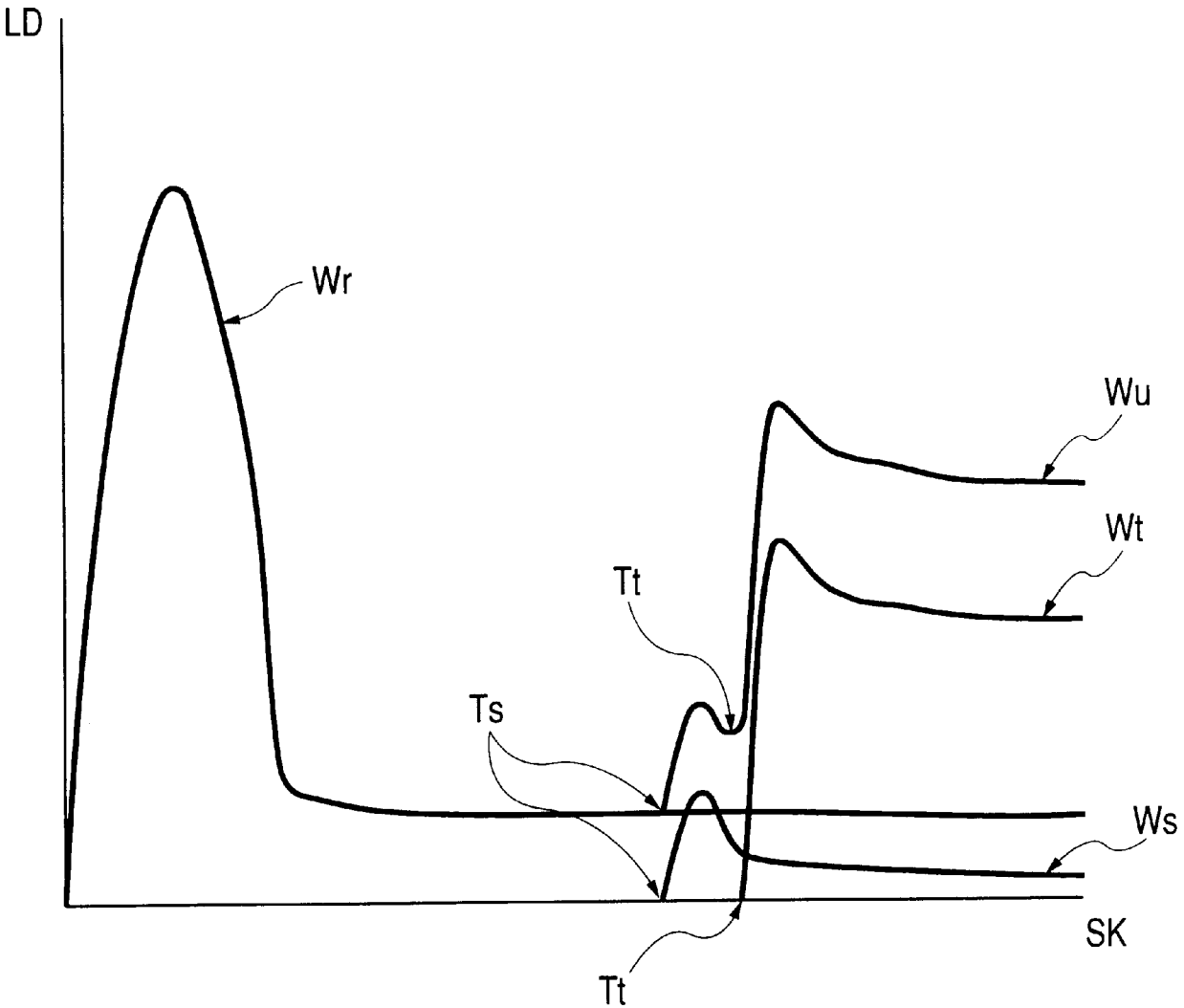
FIG. 21 is a reference diagram showing relation between a stroke and a load at the time of fitting another connector with holders.
Figure 22:
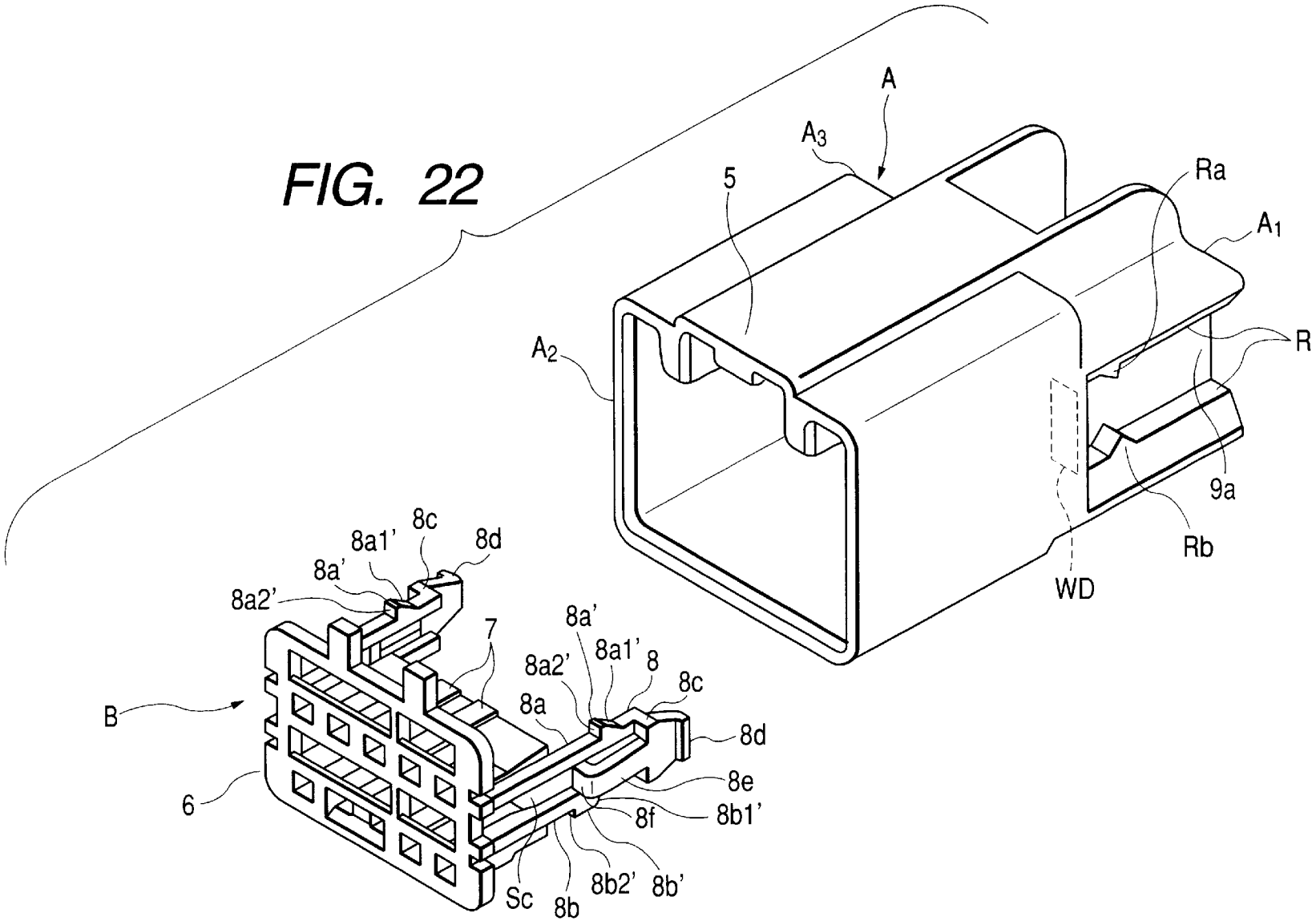
FIG. 22 is a perspective view showing a state where the conventional connector is separated from a terminal metal member insertion detecting member.
Figure 23A:
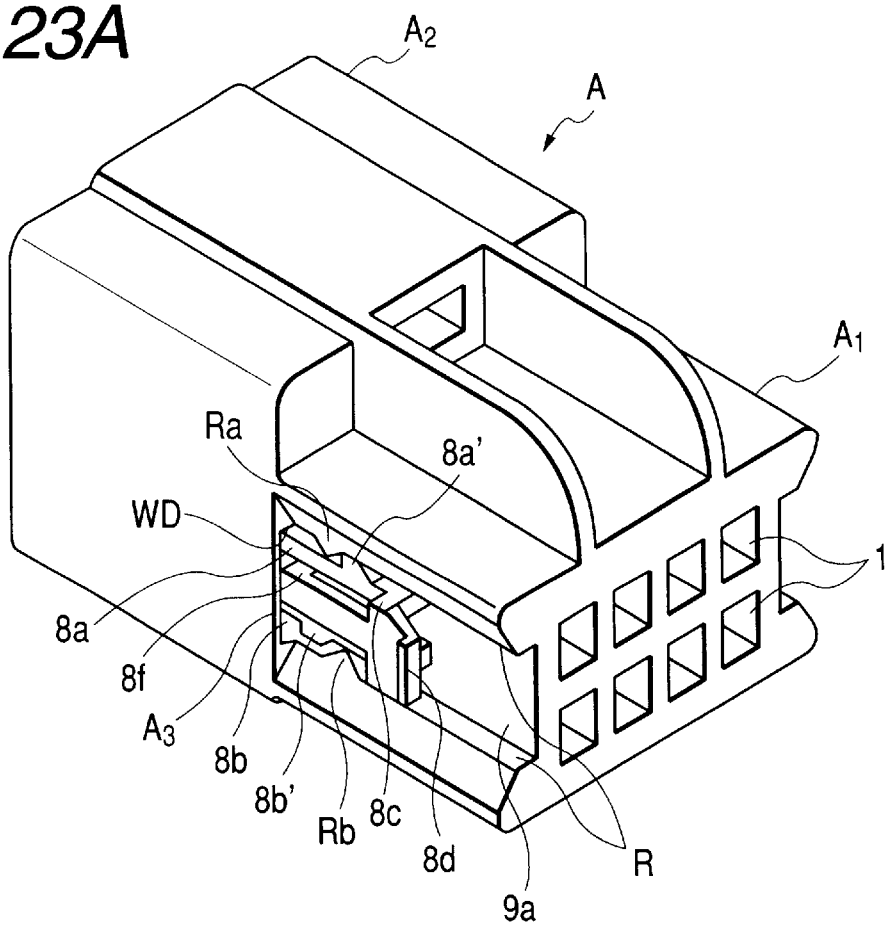
FIG. 23A is a perspective view showing a state where the terminal metal member insertion detecting member is provisionally engaged with the conventional connector.
Figure 23B:
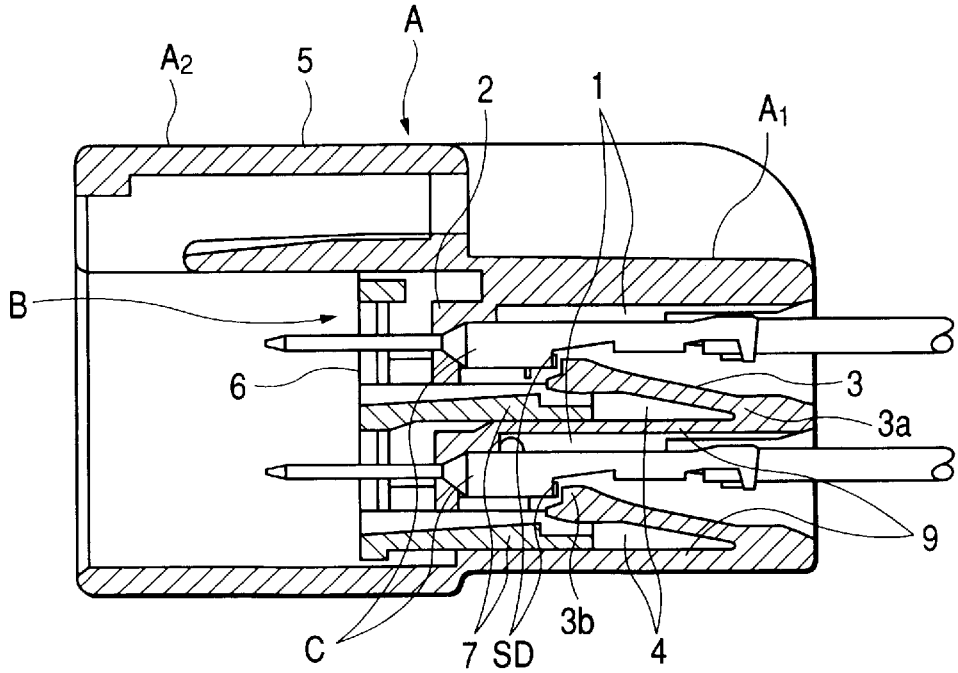
FIG. 23B is a longitudinal sectional view showing the interior along the insertion shaft direction of FIG. 23A.
Figure 24A:
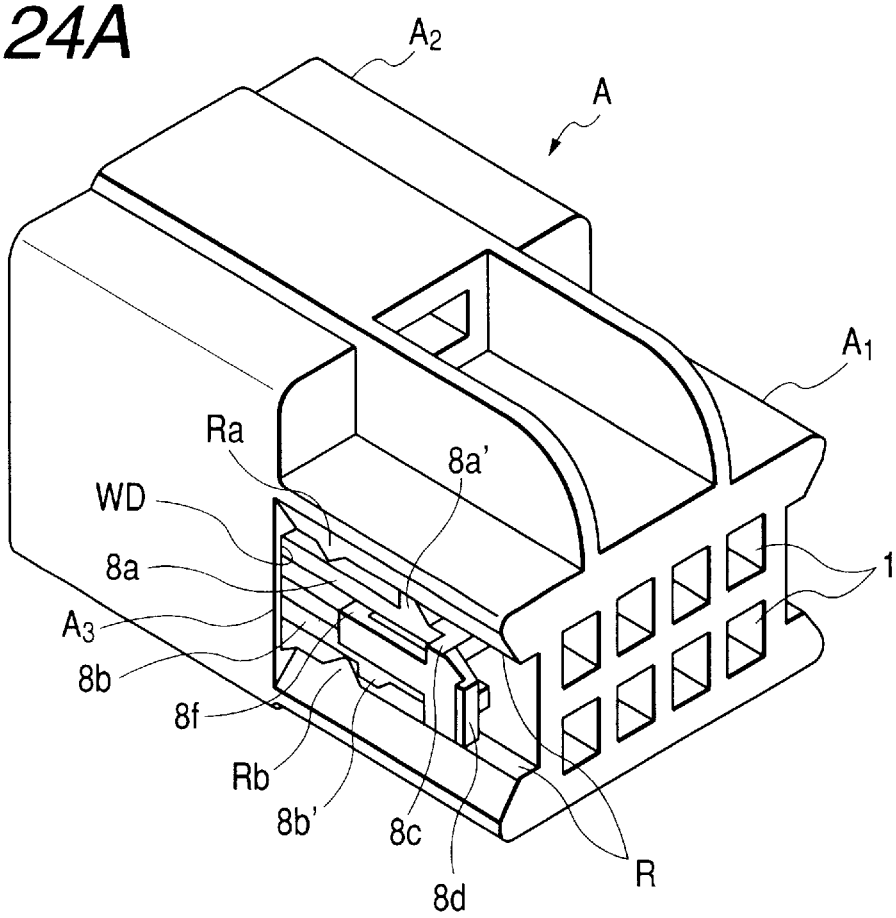
FIG. 24A is a perspective view showing a state where the terminal metal member insertion detecting member is regularly engaged with the conventional connector.
Figure 24B:
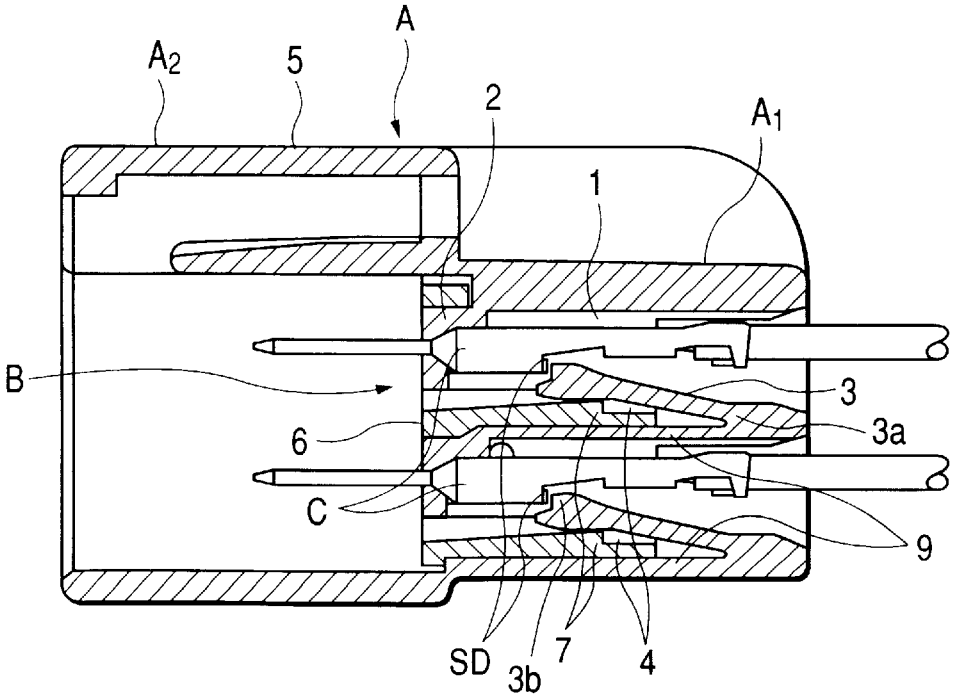
FIG. 24B is a longitudinal sectional view showing the interior along the insertion shaft direction of FIG. 24A.
Figure 25:
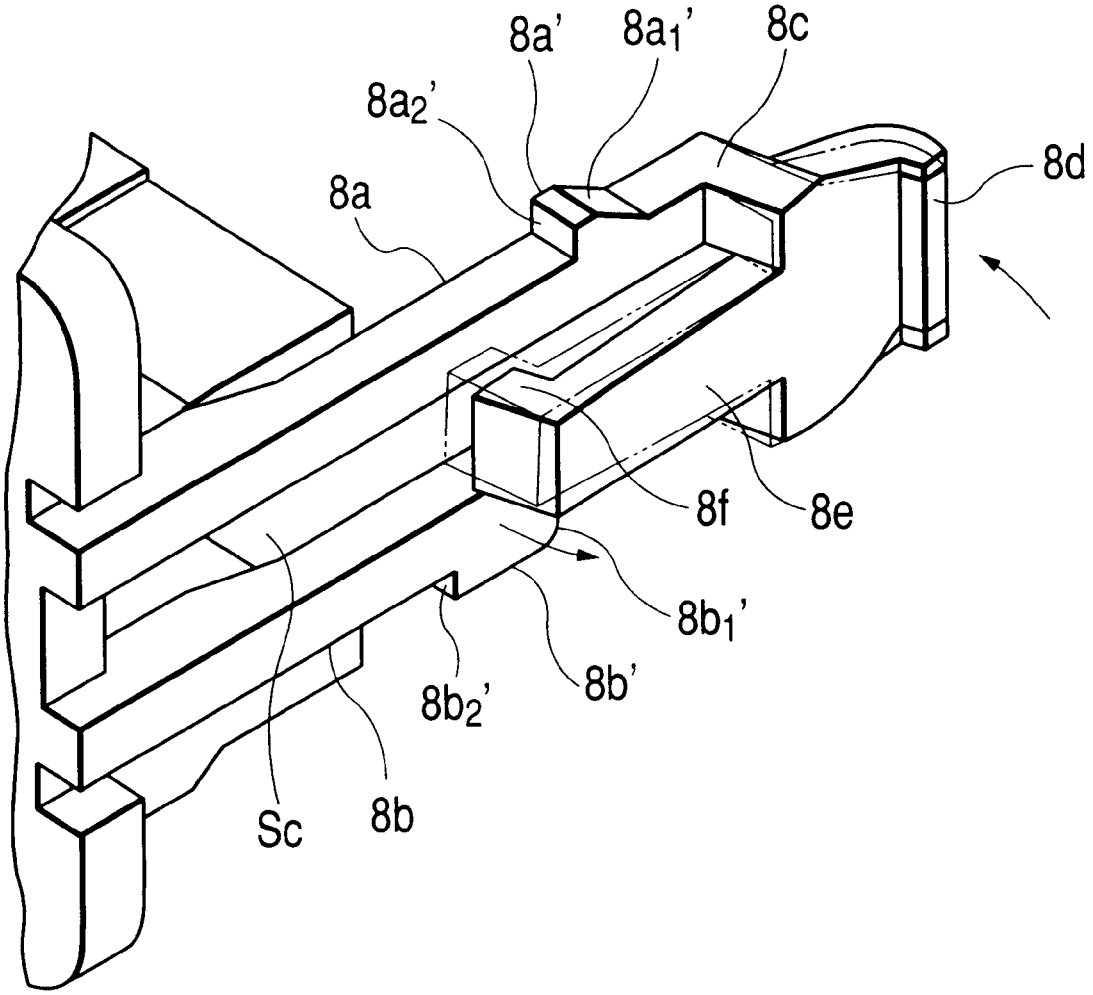
FIG. 25 is an enlarged perspective view showing the main portion of the conventional terminal metal member insertion detecting member.

FIG. 19 is an explanatory diagram showing a relation between a stroke and a load at the time of fitting the connector with holders, and FIGS. 20A to 20D are explanatory diagram also showing the relation between a stroke and a load. To be more concrete, FIG. 20A is an explanatory diagram at the time of fitting only a retaining lock portion and an engagement locking portion, FIG. 20B is an explanatory diagram at the time of fitting only the front holder and the connector housing, FIG. 20C is an explanatory diagram at the time of fitting only the male terminal and the female terminal, and FIG. 20D is an explanatory diagram at the time of fitting only the one connector and the other connector. FIG. 21 is an explanatory diagram showing a relation between a stroke and a load at the time of fitting another connector with holders and is a reference diagram shown to be compared with the invention.

The respective directions of the connector with holders will be explained based on FIGS. 1, 9, 13 and 14.

First, the "upper and lower" directions are defined as follows. That is, as shown in FIGS. 1 and 14, the side on which the engaging locking portion 14 of a connector housing 10 is provided and the side on which the retaining lock portion 64 of another connector housing 60 is provided are defined as an upper side. As shown in FIG. 14, the side on which the spacer insertion port 13 of the connector housing 10 is provided and the side on which the spacer insertion port 63 of another connector housing 60 is provided are defined as a lower side. The "upper and lower" directions in the specification means the height direction of each of connectors C1, C2 disposed in the horizontal direction as shown in FIGS. 9, 13 and 14.

The "front and rear" directions are defined as follows. That is, the fitting surface side of each of the one connector C1 shown in FIGS. 9 and 14 and the other connector C2 shown in FIGS. 13 and 14 is defined as a front side, and the electric wire coupling side on the opposite side of the front side is defined as a rear side. A front surface view and a rear surface view will be explained. The front surface view is a state where the connector is seen from the fitting surface side and the rear surface view is a state where the connector is seen from the terminal insertion side, that is, the wire coupling side.

The "left and right" directions are self-defined in accordance with the definition of the "upper and lower" directions and the "front and rear" directions. The "left and right" directions in the specification means the width direction of each of connectors C1, C2 disposed in the horizontal direction.

The definition of each of the "upper and lower" directions, the "front and rear" directions and the "left and right" directions in the specification is determined merely for convenience and does not necessarily coincide with the directions of the coupling structure for the connectors with holders upon practical use. The coupling structure for the connectors with holders according to the invention may be used in an upside down state with respect to the state shown in the drawings. As long as the object of the invention is attained, the connector with holders according to the invention may be used in any posture.

The connector according to the invention is a part which is provided at the connector housing with an electric coupling part such as a terminal or an electric wire so as to attain electric coupling. The connector concerning the invention may be one which is further provided with a sealing member such as a seal, a rubber plug, a waterproof plug in addition to the aforesaid function of the electric coupling part thereby to improve the waterproof property. Alternately, the connector concerning the invention may be one at which an additional part such as a rear holder is assembled in addition to the front holder. Alternately, a connector capable of being welded, for example, may be employed.

Explanation will be made as to the lance. The lance is also called as an engagement lance and classified into a housing lance type and a terminal lance type.

The housing lance type is one in which a terminal engagement lance formed by an arm etc. made of plastics is integrally formed within the terminal holding cavity of the connector housing, that is, a terminal housing chamber thereby to engage or stop the terminal. The arm made of plastics is generally called as a plastic arm and indicates a terminal engagement lance integrally formed with the terminal holding cavity of the connector housing.

Further, since the lance is used for engaging the terminal with the connector housing, a plate-shaped projection provided at the terminal itself is contained in the lance.

The terminal lance type will be explained, for example. The terminal lance type is one in which the terminal engagement lance is provided at the terminal itself and the terminal is engaged with and stopped by a stop portion provided at the terminal housing chamber of the connector housing.

Conductors such as one protected by insulation cover member or enamel material, one not covered any member are collectively called as the electric wires in the specification. Explanation will be made briefly as to the cable. The cable is also called as a core wire. As shown in FIG. 7A, a cable 50 is formed by a single conductor 51 protected by an insulation cover member 52 and enamel material etc. or a plurality of conductors 51 each protected by the insulation cover member 52 and enamel material etc.

As shown in FIG. 1 and FIGS. 14 to 18, the one connector C1 having a connector housing 10, a holder 20 such as a front holder 20, a spacer 30 and a male terminal 40 is fitted with the other connector, that is, the partner-side connector C2 having the other connector housing 60, the other front holder 70, the other spacer 80 and a female terminal 90, whereby the both connectors C1 and C2 are coupled so as to be electrically conductive.

The connector housing 10 shown in FIGS. 1 and 2 will be explained. In the connector housing 10, a peripheral wall 12 is formed by a top wall 12*a*, a top wall 12*a*' stepped down from the top wall 12*a*, a bottom wall 12*b*, a pair of side walls 12*c*, one side wall 15*c* continuing to the top wall 12*a*' stepped down from the top wall 12*a* and the other side wall 15*d*, and a pair of other side walls 12*c*' (see FIG. 10) respectively continuing to the side walls 15*c*, 15*d* and closing the rear side of the top wall 12*a*. Thus, a partner-side connector housing portion 17, that is, a partner-side connector housing chamber 17 and an opening 12*d* are formed at the front side of the connector housing 10.

Further, as also clear from FIGS. 1, 2 and 9, a portion 11*a*, a spacer housing portion 13 (FIG. 9), an arm housing portion 15 and a front holder main body housing portion 16 corresponding to the holder 20 are formed within the connector housing 10. Further, grooves 12*f* (FIG. 2) are provided on the inner surface side of the bottom wall 12*b* of the connector housing 10.

As shown in FIGS. 1, 2 and 9, the arm housing portion 15 is configured in a manner that an arm housing chamber 15*a* is formed by the top wall 12*a*, a separation wall 12*a*' formed so as to be extended from the top wall 12*a*' stepped down from the top wall 12*a*, the one side wall 15*c* and the other side wall 15*d* which are arranged to form an enclosure. Further, the arm housing portion is provided with a rear portion opening 15*b* at the rear side of the arm housing chamber 15*a* so that a jig (not shown) etc. for releasing the regular engagement of the front holder 20 can be inserted therein.

Furthermore, an engaging locking portion 14 is provided at the upper portion on the front side of the top wall 12*a* of the connector housing 10, and the other locking portion 18 (see FIG. 9) is provided at the lower portion on the front side of the bottom wall 12*b* of the connector housing 10.

As shown in FIGS. 1, 2 and 9, a plurality of terminal housing portions 11*a*, that is, terminal housing chambers 11*a* and rear openings lib for inserting the male terminals 40 (FIG. 9) into the terminal housing chambers 11*a* are provided at the rear side of the connector housing 10. When the male terminals 40 are inserted into the terminal housing chambers 11*a* and attached to the predetermined positions, the electric wires 50 such as cables 50 (FIG. 9) coupled to the rear portions of the male terminals 40 are extracted from the rear openings lib of the connector housing 10.

Further, as shown in FIG. 9, each of the terminal housing chambers 11*a* is formed by a separation wall 11*c* continuing from the engagement lance 11*g* and extending to the horizontal direction, a vertical separation wall lid positioned at the front side from the spacer housing portion 13 in correspondence to the separation wall, a rear side horizontal separation wall lie positioned at the rear side from the spacer housing portion 13, and a rear side vertical separation wall 11*f* in correspondence with the rear portion side horizontal separation wall.

The engagement lance 11*g* shown in FIG. 9 will be explained in detail together with FIG. 12.

The engagement lance 11*g* is provided so as to primarily engage the male terminal 40 within the terminal housing chamber 11*a* of the connector housing 10. The engagement lance 11*g* is mainly formed by a straight portion 11*h* and a stop projection 11*i*. The stop projection 11*i* is formed by a front end surface 11*j*, a slanted surface 11*k* at the front side, a slanted surface 11*m* at the rear side, and a taper-shaped guide slanted surface 11*n*. The taper-shaped guide slanted surface 11*n* is formed in a manner that the engagement projection of the engagement lance 11*g* is removed from a start end 11*p* to a termination end 11*q* thereof.

When the tip end of a jig rod (not shown) is abutted against the guide slanted surface 11*n* and the tip end of the jig rod is further pushed and advanced to the straight portion 11*h* of the engagement lance 11*g*, the engagement lance 11*g* is bent in the lower direction. Thus, the front end surface 11*j* of the engagement lance 11*g* comes out of the portion 43*a* (FIG. 6) of the male terminal 40 and is released. In this manner, the primary engagement of the male terminal 40 is released.

The spacer housing portion 13 of the connector housing 10 almost corresponds a portion shown in FIGS. 9 and 14 where the spacer 30 is housed within the connector housing 10. The spacer housing portion 13 shown in FIGS. 9 and 14 is a space portion almost corresponding to the shape of the spacer 30 shown in FIGS. 1 and 4 and formed within the connector housing 10 so as to penetrate the bottom wall 12*b* from the vicinity of the stepped-down wall portion of the connector housing 10, that is, the separation wall 12*a*' also serving the top wall 12*a*'. For convenience's sake, the reference numeral 13 used for representing both the spacer housing portion and the spacer insertion port.

As shown in FIGS. 1, 2 and 9, the engaging locking portion 14 is provided at the front side of the top wall 12*a* of the connector housing 10. The engaging locking portion 14 shown in FIGS. 1 and 2 is provided in correspondence to the retaining lock portion 64, that is, an inertia locking portion 64 of the other connector housing 60 shown in FIGS. 1 and 5

As shown in FIG. 2, the engaging locking portion 14 provided at the front side of the upper portion of the top wall 12*a* of the peripheral wall 12 forming the connector housing 10 is formed by a pair of guide concave portions 14*a*, a concave-shaped coupling portion 14*b* or an engagement concave portion 14*b*, and an engagement surface 14*c* provided at the engagement concave portion 14*b*.

Further, as shown in FIGS. 1, 2, 9 and 10, the front holder main body housing portion 16 is provided within the intermediate portion of the connector housing 10, and the arm housing portion 15 is provided at the rear side of the top wall 12*a* of the peripheral wall 12 forming the connector housing 10. The front holder main body housing portion 16 and the arm housing portion 15 formed at the connector housing 10 in this manner are provided in correspondence with the shape of the front holder 20 since the main body portion 22 and the arm portion 25 of the front holder 20 are housed within the connector housing 10.

As shown in FIGS. 1, 2 and 9, a pair of guide portions 12*e* namely a pair of introducing piece guide grooves 12*e* are provided at the inner surface side of the side walls 12*c* of the peripheral wall 12 forming the connector housing 10 in correspondence with a pair of introducing portions 24 namely a pair of introducing pieces 24 provided at the both end portions in the width direction of the main body portion 22 of the front holder 20 shown in FIGS. 1 and 3.

Further, as shown in FIG. 9, the other locking portion 18 is provided at the front surface side of the lower portion of the bottom wall 12*b* of the peripheral wall 12 forming the connector housing 10. The other locking portion 18 is mainly formed by a locking arm 18*a*, an stop projection 18*b* and a bending space etc. and used when the connector housing 10 constituting the one connector C1 engages with a locking portion provided at the other base body. To be more concrete, the other locking portion 18 formed at the connector housing 10 is provided so as to be attached to a predetermined fixing portion of an automobile etc.

Explanation will be made as to the holder 20 shown in FIGS. 1, 3 and 9.

The front holder 20 used in the invention differs from a holder for performing the double engagement of the terminal, that is, a so-called terminal metal member insertion detecting member. As clear from FIGS. 9 and 14, the holder 20 used in the invention is provided so as to protect, hold or support the electric contact portion 44 of the male terminal 40, that is, a so-called a male tab 44.

Further, as shown in FIG. 9, since the main body portion 22 is provided at the forward position of the terminal housing chamber 11*a* of the connector housing 10, the holder 20 may be called as the front holder 20 concretely. As shown in FIG. 1, the holder 20, that is, the front holder 20 is inserted into the connector housing 10 from the front side opening 12*d* of the connector housing 10 along the attachment direction S2 and attached.

As shown in FIGS. 1 and 3, the front holder 20 is formed by the main body portion 22, the arm portion 25 namely a cantilever arm 25, and a pair of the introducing portions 24 namely a pair of the introducing pieces 24. Further, as shown in FIGS. 3 and 9, the main body portion 22 of the front holder 20 is formed by a top wall 22*a*, a bottom wall 22*b*, a front wall 22*c*, side walls 22*d* and a horizontal separation wall 21*c* (FIG. 9).

The main body portion 22 of the front holder 20 is provided with a plurality of electric contact portion protruding ports 21*b* and a plurality of jig rod insertion portions 23 forming a part of a terminal insertion portion 21*a*. As shown in FIG. 9, the electric contact portion protruding port 21*b* is provided so as to penetrate the front wall 22*c* of the front holder 20 so that the electric contact portion 44 namely the male tab 44 of the male terminal 40 is extruded from the electric contact portion protruding port 21*b* provided at the front wall 22*c* of the front holder 20.

The rear side of the front wall 22*c* of the front holder 20 is formed as a slanted guide surface so that the tab 44 of the male terminal 40 can easily pass through the electric contact portion protruding port 21*b* from the rear side of the electric contact portion protruding port 21*b* provided at the front wall 22*c* of the front holder 20.

As shown in FIG. 9, a plurality of the terminal insertion portions 21*a* are provided at the main body portion 22 of the front holder 20. The terminal insertion portion 21*a* is formed by the electric contact portion protruding port 21*b*, the top wall 22*a*, the bottom wall 22*b*, the front wall 22*c*, the side walls 22*d* and the horizontal separation wall 21*c* which are arranged to form an enclosure.

The horizontal separation wall 21*c* has a single plate shape which is formed so as to partition the top wall 22*a* and the bottom wall 22*b* from the one side wall 22*d* to the other side wall 22*d* forming the main body portion 22 of the front holder 20. In this manner, the horizontal separation wall 21*c* is formed by the single plate continuing from the one side wall 22*d* to the other side wall 22*d* of the front holder 20 and there is no vertical separation wall between the one side wall 22*d* and the other side wall 22*d*.

As shown in FIGS. 3 and 9, jig rod insertion holes 23*a* and jig rod insertion ports 23*b* are provided at the front wall 22*c* of the front holder 20. As shown in FIG. 9, guide grooves 23*d* continuing to the jig rod insertion holes 23*a* are provided at the upper surface side of the bottom wall 22*b* and the upper surface side of the horizontal separation walls 21*c* of the front holder 20.

As shown in FIG. 3, a tapered guide surface 23*c* is formed at each of the jig rod insertion ports 23*b* provided at the front wall 22*c* of the front holder 20 so that the jig rod (not shown) can be easily introduced to the engagement lance 11*g* provided at the terminal housing chamber 11*a* shown in FIG. 9 through the jig rod insertion hole 23*a* and the guide groove 23*d*. In this manner, the jig rod insertion portions 23 are provided at the main body portion 22 of the front holder 20.

The front holder 20 shown in FIG. 1 is moved in the attachment direction S2 and attached within the connector housing 10. As clear from FIGS. 1 and 3, a pair of the introducing pieces 24 are provided so as to protrude from the main body portion 22 of the front holder 20 toward the rear side of the front holder 20 from the side walls 22*d* forming the main body portion 22 of the front holder 20, respectively. The pair of the introducing pieces 24 provided at the front holder 20 are fitted in correspondence with the pair of the introducing piece guide grooves 12*e* provided at the inner surface side of the side walls 12*c* of the connector housing 10 shown in FIGS. 1, 2 and 9.

When the one connector C1 and the other connector C2 shown in FIGS. 14 to 18 are fitted to each other, the cantilever arm 25 provided at the front holder 20 moves into the arm housing portion 15 provided within the connector housing 10 while being slid therealong. Thus, the cantilever arm 25 provided at the front holder 20 is protected by the peripheral wall 12 of the connector housing 10 without being exposed outside of the connector housing 10.

The cantilever arm 25 provided at the front holder 20 will be explained in detail with reference to FIGS. 3, 10 and 11. The cantilever arm 25 is configured in a manner that a provisional engagement projection 25*e* is provided at the one frame 25*c* of a flexible deformation frame 25*a* of an almost U-shape and a regular engagement projection 25*f* is provided at the other frame 25*d* of the flexible deformation frame 25*a* of the almost U-shape. Since the flexible deformation frame 25*a* is configured in the almost U-shape and has a flexible space 25*b* at the inside portion thereof, at the time of performing the provisional engagement and the regular engagement of the front holder 20 by using the cantilever arm 25, the flexible deformation frame is elastically deformed to a suitable extent and so the engagement procedure and the disengagement procedure can be performed satisfactorily.

As shown in FIGS. 3 and 11, the provisional engagement projection 25*e* provided at the flexible deformation frame 25*a* of the cantilever arm 25 of the front holder 20 is formed by a slanted sliding contact surface 25*g*, a sliding contact surface 25*h* and an engagement surface 25*i*.

The regular engagement projection 25*f* provided at the flexible deformation frame 25*a* of the cantilever arm 25 of the front holder 20 is formed by a rear side slanted sliding contact surface 25*j*, a sliding contact surface 25*k* and a front side slanted sliding contact surface 25*m*.

FIGS. 11 and 12 show a state where the cantilever arm 25 of the front holder 20 is provisionally engaged within the arm housing portion 15 of the connector housing 10.

A provisional engagement projection 15*e* is formed at the inner surface of the one side wall 15*c* of the arm housing portion 15 formed within the connector housing 10 in correspondence with the provisional engagement projection 25*e* provided at the one frame 25*c* of the flexible deformation frame 25*a* forming the cantilever arm 25 of the front holder 20. A regular engagement projection 15*f* is formed at the inner surface of the other side wall 15*d* of the arm housing portion 15 formed within the connector housing 10 in correspondence with the regular engagement projection 25*f* provided at the other frame 25*d* of the flexible deformation frame 25*a* forming the cantilever arm 25 of the front holder 20.

As shown in FIG. 11, the provisional engagement projection 15*e* provided at the inner surface of the one side wall 15*c* of the arm housing portion 15 formed within the connector housing 10 is formed by a slanted sliding contact surface 15*g*, a sliding contact surface 15*h* and an engagement surface 15*i*.

The regular engagement projection 15*f* provided at the inner surface of the other side wall 15*d* of the arm housing portion 15 formed within the connector housing 10 is formed by a front side sliding contact surface 15*j*, a sliding contact surface 15*k* and a rear side sliding contact surface 15*m*.

As shown in FIGS. 10 and 11, the cantilever arm 25 of the front holder 20 is arranged in a manner that the regular engagement and the release of the regular engagement within the arm housing portion 15 of the connector housing 10 can be performed easily.

When the cantilever arm 25 of the front holder 20 shown in FIGS. 10 and 11 is attempted to be moved along the sliding direction S3, the trapezoidal-shaped regular engagement projection 25*f* provided at the other frame 25*d* of the flexible deformation frame 25*a* is temporarily moved on the flexible space 25*b* side and moves over the regular engagement projection 15*f* provided at the inner surface of the other side wall 15*d* of the arm housing chamber 15*a* of the connector housing 10. Thereafter, the trapezoidal-shaped regular engagement projection 25*f* provided at the cantilever arm 25 of the front holder 20 is positioned at the rear side from the regular engagement projection 15*f* provided at the arm housing portion 15 of the connector housing 10. In this manner, the regular engagement is performed.

In the case of restoring the front holder 20 regularly engaged with the connector housing 10 to the provisional engagement state again, a jig tool (not shown) such as a jig rod is inserted within the arm housing chamber 15*a* from the rear portion opening 15*b* of the arm housing chamber 15*a* to push the rear end of the cantilever arm 25 of the front holder 20.

Then, the regular engagement projection 25*f* provided at the cantilever arm 25 of the front holder 20 moves over the regular engagement projection 15*f* provided at the arm housing portion 15 of the connector housing 10 and is positioned at the front side thereof while being moved temporarily to the flexible space 25*b* side of the flexible deformation frame 25*a*. In this manner, the front holder is restored to the provisional engagement state as shown in FIGS. 10 and 11.

As shown in FIG. 11, in the provisional engagement state, the engagement surface 25*i* of the provisional engagement projection 25*e* provided at the one frame 25*c* of the cantilever arm 25 of the front holder 20 and the engagement surface 15*i* of the provisional engagement projection 15*e* provided at the inner surface of the one side wall 15*c* of the arm housing portion 15 of the connector housing 10 are each formed as a vertical surface with respect to the insertion direction of the arm and made abut to each other. Thus, the front holder and the connector housing are designed so as to prevent the occurrence of such a problem that after the release of the regular engagement, for example, the front holder 20 moves out of the connector housing 10 inadvertently and so the front holder 20 is lost from the one connector C1.

Explanation will be made as to the spacer 30 shown in FIGS. 1, 4 and 9.

The spacer 30 is formed by a plurality of terminal housing portions 31*a* and a plurality of opening portions 31*b* each formed by being surrounded by respective walls, an operation portion 32, and a pair of engagement pieces 33 or a pair of engagement projection pieces 33.

The pair of engagement projection pieces 33 provided at the left and right end portions along the width direction of the spacer 30 are formed so as to have such configurations that they are held satisfactorily by a pair of engagement portions (not shown) provided within the connector housing 10 in correspondence with the engagement projection pieces. Further, as shown in FIGS. 1 and 4, the operation portion 32 of the spacer 30 is formed by a base plate 32*a* and supporting plates 32*b*, 32*c* (FIG. 9) each erected from the base plate 32*a*.

As clear from FIGS. 4 and 9, each of the terminal housing portions 31*a* is formed by upper and lower slant-shaped separation walls 31*c* and vertical separation walls 31*d* each for coupling the upper and lower slant-shaped separation walls 31*c*. The terminal housing portions 31*a* is provided with two opening portions 31*b* (FIG. 4) to have a pass-through configuration so that the male terminal 40 (FIG. 9) can pass through the terminal housing portions 31*a* provided at the spacer 30.

As shown in FIG. 4, a provisional engagement portion 34 formed by a provisional engagement projection portion 34*a* and an almost U-shaped flexible space 34*b* corresponding thereto is provided at the upper portion of the rear side of each of the engagement projection pieces 33 forming the spacer 30. A regular engagement portion 35 formed by a regular engagement projection portion 35*a* and an almost O-shaped flexible space 35*b* corresponding thereto is provided at the almost middle portion of the rear side of each of the pair of the engagement projection piece 33 forming the spacer 30.

As shown in FIG. 1, the spacer 30 is in advance inserted into the spacer housing portion 13 of the connector housing 10 along the attachment direction S1. In this case, the spacer 30 is not completely inserted into the spacer housing portion 13 of the connector housing 10 but at first attached to the connector housing 10 in a provisionally engaged state, that is, a primarily engaged state. Thereafter, the male terminal 40 (FIG. 6) to which the cable 50 is caulked and attached in advance is inserted into the connector housing 10 and the spacer 30.

As shown in FIGS. 9 and 14, the male terminal 40 thus inserted into the connector housing 10 is primarily engaged by the engagement lance 11*g* integrally formed with the connector housing 10 and then the spacer 30 is regularly engaged or secondarily engaged with the spacer housing portion 13 within the connector housing 10. Then, when the spacer 30 is completely fitted to the connector housing 10, the male terminal 40 is secondarily engaged with the connector housing 10 by means of the upper and lower slant-shaped separation walls 31*c* provided at the spacer 30.

In this manner, the male terminal 40 has been doubly engaged surely to the one connector C1 by means of the engagement lance 11*g* provided at the terminal housing chamber 11*a* of the connector housing 10 and the slant-shaped separation wall 31*c* of the spacer 30 doubly engaged with the connector housing 10. In accordance with such an arrangement, such a problem can be surely prevented from occurring that when the cable 50 is pulled inadvertently, for example, the male terminal 40 attached to the cable 50 comes out from the connector housing 10.

As to this matter, the female terminal 90 (FIG. 13) provided at the other connector C2 is also double engaged with the other connector C2 by the same reason. The female terminal 90 shown in FIG. 13 is doubly engaged surely to the other connector C2 by means of the engagement lance 61*g* provided at the terminal housing chamber 61*a* of the connector housing 60 and the slant-shaped separation wall 81*c* of the other spacer 80 doubly engaged with the other connector housing 60.

The spacer 30 shown in FIG. 4 is arranged in a manner that the upper side slant-shaped separation wall 31*c* also serves as a top wall and each of the most right side wall and the most left side wall of the vertical separation walls 31*d* serves as a side wall. Further, no vertical separation wall is formed on the upper side slant-shaped separation wall 31*c*. The terminal housing portions 31*a* are aligned in a line in the width direction of the spacer 30 in a manner that about six terminal housing portions are provided at the spacer 30. The spacer 30 used in the invention may be spacers of any configuration.

Explanation will be made as to the male terminal 40 shown in FIG. 6.

The male terminal 40 is formed in a predetermined shape in a manner that at first plate member made of metal is subjected to a punching process to form material for the terminal metal member and then the material for the terminal metal member is subjected to a bending process.

The male terminal 40 formed by being subjected to the respective pressing processes in this manner is formed by an electric wire coupling portion 41, an electric contact portion 44, a coupling portion 42 for coupling the electric wire coupling portion 41 and the electric contact portion 44, a provisional engagement projection 43*a* and a regular engagement projection 43*b*, and a positioning projection 45 for attaching the male terminal 40 to the terminal housing chamber in a correct direction at the time of inserting the male terminal 40 into the terminal housing chamber.

The electric wire coupling portion 41 of the male terminal 40 is formed by a conductor press-contact piece 41*a* and two cover press-contact pieces 41*b* provided in a crossing pattern. The electric contact portion 44 namely a male tab 44 of the male terminal 40 is formed by a root portion 44*a*, a main body 44*b* and a tip end 44*c*. The tip end 44*c* of the tab 44 of the male tab 40 is formed in a tapered guide shape (see FIGS. 6 and 10) so that the male terminal 40 can be easily and quickly entered into a predetermined insertion portion.

A portion of the male terminal 40 between the provisional engagement projection 43*a* and the regular engagement projection 43*b* is set as an engagement lance housing portion 43*c*, and a portion between the regular engagement projection 43*b* and the cover press-contact piece 41*b* is set as a separation wall housing portion 43*d*. When the slant-shaped separation wall 31*c* of the spacer 30 is fitted into the separation wall housing portion 43*d* of the male terminal 40, the male terminal 40 is secondarily engaged with the connector housing 10 (FIG. 9).

Explanation will be made as to the other connector housing 60 shown in FIGS. 5 and 13.

In the connector housing 60, a peripheral wall 62 is formed by a top wall 62*a*, a bottom wall 62*b* and a pair of side walls 62*c*. Further, as clear from FIGS. 1, 5 and 13, in the other connector housing 60, there are formed a terminal housing portion 61*a*, a spacer housing portion 63, and a front holder supporting portion 66 (FIG. 13) extended from the bottom wall 62*b*. Furthermore, the retaining lock portion 64 namely the inertia locking portion 64 is provided at the top wall 62*a* of the other connector housing 60.

Further as shown in FIGS. 1, 5 and 13, the other connector housing 60 is provided with a plurality of terminal housing portions 61*a* namely terminal housing chambers 61*a* and rear portion openings 61*b* for inserting the female terminals 90 (FIG. 13) into the terminal housing portions 61*a*. When the female terminal 90 is inserted within the terminal housing chamber 61*a* and attached to a predetermined position, the electric wire 50 such as the cable 50 (FIG. 13) etc. coupled to the rear portion of the female terminal 90 is extruded from the rear portion opening 61*b* of the other connector housing 60.

Further, as shown in FIG. 13, each of the terminal housing chambers 61*a* is formed by a separation wall 61*c* continued from the engagement lance 61*g* and extending in the horizontal direction, a vertical separation wall 61*d* positioned at the front side from the spacer housing portion 63 in correspondence with the separation wall, a rear portion side horizontal separation wall 61*e* positioned a the rear side from the spacer housing portion 63, and a rear portion side vertical separation wall 61*f* in correspondence with the rear portion side horizontal separation wall.

The engagement lance 61*g* integrally formed with the other connector housing 60 shown in FIG. 13 performs a function similar to that of the engagement lance 11*g* shown in FIGS. 9 and 12. A sectional position in a longitudinal sectional view of the other connector C2 shown in FIG. 13 differs partially from a sectional position in a longitudinal sectional view of the one connector C1 shown in FIG. 9.

The spacer housing portion 63 is almost corresponding to the portion where the other spacer 80 shown in FIGS. 13 and 14 is housed within the other connector housing 60. The spacer housing portion 63 is configured in a manner that it penetrates the bottom wall 62*b* from the vicinity of the top wall 62*a* of the other connector housing 60 and formed within the other connector housing 60. In this respect, a reference numeral 63 is used for representing the spacer housing portion and the spacer insertion port.

As shown in FIGS. 1, 5 and 13, the retaining lock portion 64 namely the inertia locking portion 64 is provided on the top wall 61*a* of the other connector housing 60. The retaining lock portion 64 shown in FIGS. 1 and 5 is provided in correspondence with the engaging locking portion 14 of the connector housing 10 shown in FIGS. 1 and 2.

As clear from FIGS. 5 and 13, the retaining lock portion 64 provided at the upper portion of the top wall 62*a* of the peripheral wall 62 forming the other connector housing 60 is formed by a pair of guide projection portions 64*a*, a double support arm 64*d* formed by a flexible coupling portion 64*e*, and a flexible space 64*e*' (FIG. 13) thereof, and a locking projection 64*b* and a pair of stepped projection portion 64*h* provided on the flexible coupling portion 64*e* of the double support arm 64*d*.

The locking projection 64*b* or the stop projection 64*b* is formed by an engagement surface 64*c* (FIG. 13), a slanted slide-contact surface 64*f*, an initial abutment surface 64*g* (FIG. 13) and a pair of side surfaces. A coupling piece 65 (FIG. 5) is further provided from the one of the pair of the guide projection portions 64*a* to the other thereof.

The pair of the stepped projection portion 64*h* provided at the inertia locking portion 64 are provided so that the double support arm 64*d* formed by the flexible coupling portion 64*e* can be pushed easily by a finger etc. in order to positively bend the double support arm 64*d* of the retaining lock portion 64 provided at the other connector C2 at the time of performing the fitting operation or the release of the fitting operation between the one connector C1 and the other connector C2.

The flexible space 64*e*' (FIGS. 13 and 16) of the retaining lock portion 64 is an important space (see FIG. 16) for the double support arm 64*d* formed by the flexible coupling portion 64*e* to be able to elastically bend suitably when the engaging locking portion 14 of the one connector C1 side and the retaining lock portion 64 of the other connector C2 side are engaged and stopped to each other at the time of fitting the one connector C1 and the other connector C2.

Further, as shown in FIG. 5, a pair of engagement portions 62*d* or a pair of engagement concave portions 62*d* are provided at the side walls 62*c* of the peripheral wall 62 forming the other connector housing 60 in correspondence with a pair of engagement portions 72*d* or a pair of engagement projections 72*d* provided at the both end portions in the width direction of the other front holder 70.

The other front holder 70 shown in FIGS. 1, 5 and 13 will be explained.

As shown in FIGS. 13 and 14, the front holder 70 differs from the front holder by which the double engagement of the terminal is performed. As shown in FIG. 13, the other front holder 70 is formed by a top wall 72*a*, a bottom wall 72*b*, a front wall 72*c*, side walls and a horizontal separation wall 71*c*. The housing portion at the front side portion of the female terminal 90 is formed by arranging these walls so as to form an enclosure.

The horizontal separation wall 71*c* has a single plate shape formed so as to partition the top wall 72*a* and the bottom wall 72*b* from the one side wall to the other side wall forming the other front holder 70. In this manner, the horizontal separation wall 71*c* is formed by the single plate continuing from the one side wall to the other side wall forming the other front holder 70, and there is no vertical separation wall between the one side wall and the other side wall.

The other front holder 70 is provided with a plurality of terminal insertion ports 71*b* having tapered guide surfaces 71*a* and a plurality of jig rod insertion portions (not shown).

As clear from FIGS. 13 to 18, the tapered guide surface 71*a*(FIGS. 13 and 17) is formed at the terminal insertion port 71*b* so as to introduce the electric contact portion 44 or the male tab 44 of the male terminal 40 satisfactorily within a terminal housing chamber 95*a* provided at the electric contact portion 94 of the female terminal 90 shown in FIG. 17 through the terminal insertion port 71*b* provided at the front wall 72*c* of the other front holder 70.

The plurality of the jig rod insertion portions are provided by the similar reason as that of the jig rod insertion portions 23 shown in FIGS. 3 and 9. A sectional position in a longitudinal sectional view of the other connector C2 shown in FIG. 13 differs partially from a sectional position in a longitudinal sectional view of the one connector C1 shown in FIG. 9.

As shown in FIG. 5, the pair of the engagement portions 72*d* are provided at the both end portions in the width direction of the other front holder 70. The pair of the engagement portions 72*d* provided at the other front holder 70 are fitted in correspondence with the pair of the engagement concave portions 62*d* provided at the side walls 62*c* of the other connector housing 60. In this manner, the other front holder 70 is attached to the other connector housing 60.

The other spacer 80 shown in FIG. 13 will be explained.

The spacer 80 is formed by a plurality of terminal housing portions 81*a* and opening portions formed by being surrounded by the respective walls, an operation portion 82, an operation projection portion 83 continuing to the operation portion 82, and a pair of engagement projection pieces (not shown) provided at the left and right both end portions in the width direction of the other spacer 80.

Like the spacer 30 shown in FIGS. 4 and 9, the operation portion 82 of the other spacer 80 shown in FIG. 13 is formed by a base plate and respective supporting plates erected from the base plate. The operation projection portion 83 continuing to the operation portion 82 provided at the other spacer 80 is fitted into the attachment portion provided at the bottom wall 62*b* of the other connector housing 60 in corresponding to these portions.

The pair of the engagement projection pieces provided at the other spacer 80 is formed to have a shape similar to that of the engagement projection piece 33 of the spacer 30 shown in FIG. 4. The pair of the engagement projection pieces are formed to have such a shape to be held satisfactorily by the pair of the engagement portions (not shown) provided within the other connector housing 60 in correspondence with the pair of the engagement projection pieces.

As shown in FIG. 13, the terminal housing portion 81*a* is formed by upper and lower slant-shaped separation walls 81*c* and vertical separation walls 81*d* respectively coupling the upper and lower slant-shaped separation walls 81*c*. The terminal housing portion 81*a* provided at the other spacer 80 is provided with two opening portions to form a passing-through shape so that the female terminal 90 can be inserted into the terminal housing portion 81*a* provided at the other spacer 80.

The other spacer 80 is inserted into the spacer housing portion 63 of the other connector housing 60 at the beginning of the assembling process of the other connector C2. In this case, the other spacer 80 is not completely inserted into the spacer housing portion 63 of the other connector housing 60 but, at first, the other spacer is attached to the other connector housing 60 in a primarily engaged state. Then, the female terminal 90 to which the cable 50 is caulked and attached in advance is inserted into the other connector housing 60 and the other spacer 80.

Thereafter, as shown in FIGS. 13 and 14, the female terminal 90 inserted into the other connector housing 60 is primarily engaged by the engagement lance 61*g* integrally formed with the other connector housing 60 and then the other spacer 80 is secondarily engaged with the spacer housing portion 63 of the other connector housing 60. When the other spacer 80 is completely fitted with the other connector housing 60, the female terminal 90 is secondarily engaged with the other connector housing 60 by means of the upper and lower slant-shaped separation walls 81*c* provided at the other spacer 80. In this manner, the female terminal 90 is surely engaged doubly with the other connector C2.

The other spacer 80 shown in FIG. 13 is arranged in a manner that the upper side slant-shaped separation wall 81*c* also serves as a top wall and each of the most right side wall and the most left side wall of the vertical separation walls 81*d* serves as a side wall. Further, no vertical separation wall is formed on the upper side slant-shaped separation wall 81*c*. The terminal housing portions 81*a* are aligned in a line in the width direction of the other spacer 80 in a manner that about six terminal housing portions are provided at the spacer 80. The spacer 80 used in the invention may be spacers of any configuration.

As shown in FIGS. 1, 9, 13 and 14, the spacer used in the invention may be the spacers 30, 80 which are a type of being attached in the upper and lower direction, that is, inserted from the bottom walls 12*b*, 62*b* sides of the connector housings 10, 60. Alternately, the spacer used in the invention may be a type of being attached in the left and right direction, that is, inserted from the side walls 12*c*, 62*c* sides of the connector housings 10, 60. In this manner, the spacer used in the invention may be ones of any configuration.

Each of the connector housings 10, 60, the front holders 20, 70 and the spacers 30, 80 has the complicated configuration. Such members having the complicated configurations are desirably formed by material suitable for mass-production, for example, synthetic resin capable of being injection-molded and having thermoplastic property and more preferably synthetic resin with elastic property.

As the synthetic resin capable of being injection-molded and having thermoplastic and elastic property, there is raised, for example, polybutylene terephthalate resin (abbreviated as PBT), acrylonitrile-butadiene-styrene resin (abbreviated as ABS), polyamide resin (abbreviated as PA), polypropylene resin ((abbreviated as PP) etc. Various kinds of filler may be added to the synthetic resin as the need arises.

The connector housings 10, 60, the front holders 20, 70 and the spacers 30, 80 used in the example of the embodiment of the invention are formed by polybutylene terephthalate resin (PBT) and so excellent in the stability of sizes and strengths thereof and in electric characteristics thereof. PBT-H01 etc., for example, may be raised as polybutylene terephthalate resin (PBT)

Each of the molding bodies such as the connector housings 10, 60, the front holders 20, 70 and the spacers 30, 80 may be subjected to the tumbling process, that is, the so-called polishing process as the need arises, and then after being taken out of the mold, burr remained at the molding body may be removed.

As shown in FIGS. 1 to 5, the corner portion of each of the connector housings 10, 60, the front holders 20, 70 and the spacers 30, 80 is configured in a chamfered shape as the need arises. The "chamfer" means a state that a corner portion where one surface and another surface cross to each other is slanted or rounded. In this respect, the C chamfer means a chamfer with a slanted shape and the R chamfer means a chamfer with a rounded shape.

The chamfered portion is provided also in order to absorb the concentration of the stress applied to the corner portion and also to prevent the occurrence of such a trouble that a worker treating the connector housings 10, 60, the front holders 20, 70 and the spacers 30, 80 may be injured at his hands etc. by the corner portions thereof. Such a chamfer may be formed by the tumbling process.

Explanation will be made as to the female terminal 90 shown in FIGS. 7A and 7B.

The female terminal 90 is formed in a predetermined shape in a manner that at first plate member made of metal is subjected to a punching process to form material for the terminal metal member and then the material for the terminal metal member is subjected to a bending process.

The female terminal 90 formed by being subjected to the respective pressing processes in this manner is formed by an electric wire coupling portion 91, an electric contact portion 94, a coupling portion 92 for coupling the electric wire coupling portion 91 and the electric contact portion 94, a provisional engagement projection 93*a* and a regular engagement projection 93*b*.

The electric wire coupling portion 91 of the female terminal 90 is formed by conductor press-contact pieces 91*a* and two cover press-contact pieces 91*b* provided in a crossing pattern. As shown in FIG. 7A, of the electric wire 50 such as the cable 50, the conductor 51 formed by copper-system material such as an annealed copper wire is caulked by the conductor press-contact pieces 91*a* provided at the female terminal 90, whereby the female terminal 90 and the cable 50 are coupled so as to be conductive. The insulation cover member 52 constituting the cable 50 and formed by soft resin material, rubber material or mixed material (admixture) thereof is caulked by the two cover press-contact pieces 91*b* provided in the crossing pattern at the rear side of the female terminal 90. Incidentally, the coupling state of the male terminal 40 and the cable 50 shown in FIG. 6 is similar to the coupling state caused by the caulking explained above with reference to FIG. 7A.

As clear from FIGS. 7A and 7B, the electric contact portion 94 of the female terminal 90 is configured in a rectangular tubular box shape and has the terminal housing chamber 95*a* therein. The tab 44 of the male terminal 40 shown in FIG. 6 is inserted into the terminal housing chamber 95*a* of the electric contact portion 94 of the female terminal 90 shown in FIG. 7A.

Further, as shown in FIGS. 7A and 7B, the portion between the provisional engagement projection 93*a* and the regular engagement projection 93*b* of the female terminal 90 is set as an engagement lance housing portion 93*c* and the portion between the regular engagement projection 93*b* and the cover press-contact pieces 91*b* is set as a separation wall housing portion 93*d*. When the slant-shaped separation wall 81*c* of the other spacer 80 is fitted into the separation wall housing portion 93*d* of the female terminal 90, the female terminal 90 is secondarily engaged with the other connector housing 60 (FIG. 13).

Explanation will be made in detail as to the electric contact portion 94 of the female terminal 90 with reference to FIGS. 7A and 8. The electric contact portion 94 of the female terminal 90 is formed by a base wall 95*c*, the other wall 95*d* positioned in an opposite manner and almost in parallel to the base wall 95*c*, and a pair of side walls 95*e* coupling the both sides of the base wall 95*c* and the both sides of the other wall 95*d*, thereby being configured in a rectangular cylindrical box shape. In this manner, the terminal housing chamber 95*a* and the opening 95*b* are formed at the electric contact portion 94 of the female terminal 90. Further, an elastic contact piece 96 and a flexible supporting piece 97 are provided at the electric contact portion 94 of the female terminal 90.

As shown in FIG. 8, the other wall 95*d* positioned in the opposite manner and almost in parallel to the base wall 95*c* is protruded toward the terminal housing chamber 95*a* side to form a pair of projections 95*f*. The pair of the projections 95*f* provided at the other wall 95*d* positioned in the opposite manner and almost in parallel to the base wall 95*c* serve as a pair of contact points 95*f* for the female terminal 90 to be coupled to the tab 44 (see FIGS. 6 and 18) of the male terminal 40.

The base wall 95*c* of the electric contact portion 94 of the female terminal 90 is turned down toward the inside of the terminal housing chamber 95*a* from the vicinity of the opening 95*b* of the female terminal 90 to form the elastic contact piece 96. The elastic contact piece 96 is configured in a manner that it is extended toward the inner side of the terminal housing chamber 95*a* while being slanted gently, then further extended while being slanted gently again through a top portion 96*b* and made in contact with the base wall 95*c* in the vicinity of the free end 96*c* of the elastic contact piece 96.

The free end 96*c* of the elastic contact piece 96 is configured in a manner that the elastic contact piece 96 gradually approaching from the top portion 96*b* to the base wall 95*c* and abutting against thereto is slightly bent in a direction leaving from the base wall 95*c* again. The curved surface of the elastic contact piece formed in this manner is made in contact so as to be slidable with the inner surface of the base wall 95*c* forming the terminal housing chamber 95. Thus, the base wall 95*c* of the female terminal 90 is not easily scratched by the free end 96*c* of the elastic contact piece 96 and the free end 96*c* of the elastic contact piece 96 can be moved smoothly.

A pair of engagement projections are provided in the left and right direction of the top portion 96*b* of the elastic contact piece 96, that is, the width direction of the top portion 96*b* of the elastic contact piece 96 existing within the terminal housing chamber 95 of the rectangular box shape when seeing the female terminal 90 from the opening 95*b* side. The pair of the engagement projections provided in the width direction of the top portion 96*b* of the elastic contact piece 96 are fitted to and held by windows 95*g* provided at the pair of side walls 95*e* of the female terminal 90 shown in FIG. 7B.

As shown in FIG. 8, a portion of the base wall 95*c* is punched out at the vicinity of the portion where the free end 96*c* of the elastic contact piece 96 provided at the female terminal 90 is positioned and gently bent toward the terminal housing chamber 95*a* side to form the flexible supporting piece 97. The flexible supporting piece 97 is configured in a manner that it is extended toward the inner side of the terminal housing chamber 95*a* from a bent portion 97*a* corresponding to a portion in the vicinity of the free end 96*c* of the elastic contact piece 96 while being slanted gently, and further extended to a free end 97*b* having a shape similar to an almost spoon shape formed in correspondence with a portion in the vicinity of the top portion 96*b* of the elastic contact piece 96.

When it is arranged that the rear surface of the top portion 96*b* of the elastic contact piece 96 is abutted against and pushed by the curved surface of the free end 97*b* with the almost spoon shape of the flexible supporting piece 97, the rear surface of the top portion 96*b* of the elastic contact piece 96 is not easily scratched by the free end 97*b* of the elastic supporting piece 97 and the top portion 96*b* of the elastic contact piece 96 can be moved smoothly.

The elastic contact piece 96 and the flexible supporting piece 97 are elastically made in contact to each other. The top portion 96*b* provided at the elastic contact piece 96 serves as a contact point for the female terminal 90 to be coupled to the tab 44 (see FIGS. 6 and 18) of the male terminal 40.

The electric contact portion 44, that is, the main body 44*b* of the tab 44 of the male terminal 40 shown in FIG. 6 is sandwiched by the top portion 96*b* or the other contact point 96*b* provided at the elastic contact piece 96 and the pair of contact points 95*f* provided at the other wall 95*d* positioned in the opposite manner and almost in parallel to the base wall 95*c* shown in FIG. 8, whereby the male terminal 40 and the female terminal 90 are fitted to each other as shown in FIG. 18. Thus, the one connector C1 is coupled to the other connector C2 so as to be conductive through the male terminal 40 and the female terminal 90.

The electric contact portion of the male terminal is sandwiched by the three points, that is, the other contact point 96*b* provided at the elastic contact piece 96 and the pair of contact points 95*f* provided at the other wall 95*d* positioned in the opposite manner and almost in parallel to the base wall 95*c* of the female terminal 90 shown in FIG. 8.

According to this arrangement, the sliding resistance at the time of coupling the male terminal 40 and the female terminal 90 shown in FIGS. 16 to 18 is reduced. Thus, at the time of performing the male-female fitting operation of a multi-pole connector such as a connector with twelve poles in total (see FIGS. 1 and 5), the fitting force is reduced even if only slightly and so it is expected that a connector which can perform the male-female fitting operation with good feeling even if only slightly can be provided.

The female terminal may be one which is configured in a manner that two contact points are provided at the base wall 95*c* forming the electric contact portion 94 of the female terminal and an elastic contact piece having one contact point is provided at the other wall 95*d*. Alternately, the female terminal may be a so-called terminal with two parts which is configured in a manner that the elastic contact piece of another part is assembled to the terminal housing chamber 95*a* of the female terminal 90. In this manner, the female terminal used in the connector with holders according to the invention may be a female terminal of any configuration.

The copper system material such as bronze, copper alloy, aluminum alloy may be raised as the material of terminals etc. such as the male terminal 40, the female terminal 90 or bus bars. The material of the terminals etc. such as the male terminal 40, the female terminal 90 or the bus bars used in the invention may be metal material having conduction function or any type of material so long as it is conductor capable of conducting electric current satisfactorily.

The material may be subjected to the surface protection process such as the metal plating in order to improve the corrosion resistively thereof. As long as the material can maintain its performance sufficiently under the normally used condition, such a surface protection process is preferably eliminated in view of the reduction of cost.

As shown in FIGS. 14 to 18, the embodiment of the coupling structure for the connectors with holders according to the invention is provided with the one connector C1 which is configured by containing in the connector housing 10 the male terminal 40, the front holder 20 for protecting, holding or supporting the electric contact portion 44 or the male tab 44 (FIG. 6) of the male terminal 40 and the spacer 30 for doubly engaging the male terminal 40 and the other connector C2 which is configured by containing in the connector housing 60 the female terminal 90.

As shown in FIG. 14, the other connector C2 is moved toward the one connector C1 along the fitting direction S4 of the connector thereby to start the fitting operation of the connectors. Then, the front surface 72*c*' of the other connector C2 pushes the front surface 22*c*' of the front holder 20 housed within the connector housing 10 of the one connector C1 (FIGS. 16 and 17), whereby the state between the connector housing 10 of the one connector C1 and the front holder 20 is shifted from the provisional engagement state to the regular engagement state.

As shown in FIGS. 9 to 11, the front holder 20 having been held in the connector housing 10 constituting the one connector C1 in the provisional engagement state is moved in the sliding direction S3 shown by an arrow S3 in a slidable contact manner, and then the front holder 20 is regularly engaged with the connector housing 10.

The male terminal 40 of the one connector C1 is coupled to the female terminal 90 of the other connector C2 (FIG. 18) the moment the state between the connector housing 10 of the one connector C1 and the front holder 20 is shifted from the provisional engagement state to the regular engagement state, whereby the one connector C1 is fitted to the other connector C2.

In this manner, the shifting operation of the state between the connector housing 10 of the one connector C1 and the front holder 20 from the provisional engagement state to the regular engagement state and the coupling operation between the male terminal 40 of the one connector C1 and the female terminal 90 of the other connector C2 can be performed simultaneously. Thus, the fitting operation between the connectors C1 and C2 can be performed by once collectively, and so the operation feeling at the time of performing the fitting operation between the connectors C1 and C2 can be improved.

The regular engagement of the front holder 20 to the connector housing 10 is performed by the fitting operation between the one connector C1 and the other connector C2. Thus, a so-called male-female fitting operation of two-step feeling, in which the regular engagement between the connector housing 10 and the front holder 20 is performed separately from the coupling between the male terminal 40 of the one connector C1 and the female terminal 90 of the other connector C2.

Therefore, it is possible to prevent the occurrence of such a trouble state of the unfinished engagement state, that is, the half engagement state or the unfinished fitting state, that is, the half fitting state of the front holder 20 which is feared to be occurred at the time of coupling the one connector C1 and the other connector C2.

Further, as shown in FIGS. 1, 3 and 9 to 11, the flexible cantilever arm 25 of an almost U-shape extended toward the rear side of the front holder 20 is provided at the top wall 22*a* of the main body portion 22 of the front holder 20.

The potion 15 extended to the rear side of the connector housing 10 along the longitudinal direction of the cantilever arm 25 is provided within the connector housing 10. The arm housing portion 15 forms the arm housing chamber 15*a* having the rear portion opening 15*b*. The cantilever arm 25 of the front holder 20 is slidably made in contact along the longitudinal direction of the arm housing portion 15 provided within the connector housing 10.

To be explained more in detail, as shown in FIGS. 3, 10 and 11, the flexible space 25*a* is provided within the flexible deformation frame 25*a* forming the cantilever arm 25 of the front holder 20. The provisional engagement projection 25*e* is provided at the rear side of the cantilever arm 25 of the front holder 20 from the regular engagement projection 25*f*, and the provisional engagement projection 25*e* and the regular engagement projection 25*f* are disposed in a crossing pattern at the cantilever arm 25.

Further, as shown in FIGS. 2, 9 and 10, the arm housing portion 15 of the connector housing 10 is configured in a manner that the arm housing chamber 15*a* is formed by the top wall 12*a*, the separation wall 12*a*' and the pair of side walls 15*c*, 15*d* which are arranged to form an enclosure. As shown in FIGS. 10 and 11, the provisional engagement projection 15*e* is formed at the inside of the one side wall 15*c* of the arm housing chamber 15*a* in correspondence with the provisional engagement projection 25*e* at the outside of the one frame 25*c* forming the cantilever arm 25 of the front holder 20.

Further, the regular engagement projection 15*f* is formed at the inside of the other side wall 15*d* of the arm housing chamber 15*a* in correspondence with the regular engagement projection 25*f* at the outside of the other frame 25*d* forming the cantilever arm 25 of the front holder 20. The provisional engagement projection 15*e* is provided at the front side of the arm housing portion 15 of the connector housing from the regular engagement projection 15*f*, and the provisional engagement projection 15*e* and the regular engagement projection 15*f* are disposed in a crossing pattern within the arm housing chamber 15*a*.

According to such an arrangement, since the flexible cantilever arm 25 provided at the front holder 20 is protected by the arm housing portion 15 within the connector housing 10, the flexible cantilever arm 25 of the front holder 20 is prevented from being exposed outside of the connector housing 10.

Thus, it is possible to prevent the occurrence of such a trouble that other member hits against the flexible front holder 20 to cause plastic deformation at the flexible front holder 20 and so the front holder 20 regularly engaged with the connector housing 10 can not be restored to the provisional engagement state. After the fitting of the connectors C1 and C2, the cantilever arm 25 of the front holder 20 is also not exposed outside and housed within the arm housing portion 15 of the connector housing 10 and hence protected from the outside (FIG. 18).

Further, since the flexible cantilever arm 25 of the front holder 20 is provided with the stop and engagement mean, the holder can be easily maintained at the provisional engagement state and also can be easily maintained at the regular engagement state within the arm housing chamber 15*a* of the connector housing 10. Thus, it is possible to prevent the occurrence of such a trouble that the front holder 20 is separated from the connector housing 10 to be gotten lost and so the male terminal 40 provided within the connector housing 10 is not protected by the front holder 20.

Further, as shown in FIGS. 1, 3 and 9, the pair of the introducing pieces 24 extended toward the rear side of the front holder 20 are formed at the both sides in the left and right width direction of the main body portion 22 forming the front holder 20. As shown in FIGS. 1, 2 and 9, the introducing piece guide grooves 12*e* are formed at the inner surfaces of the pair of the side walls 12*c* forming the connector housing 10 in correspondence with the pair of the introducing pieces 24.

According to such an arrangement, before the front holder 20 is provisionally engaged with the connector housing 10 after the front holder 20 starts to be housed within the connector housing 10, the front holder 20 can be housed within the connector housing 10 easily and quickly with a predetermined posture without being broken. Thus, the cantilever arm 25 of the front holder 20 can be introduced easily and quickly into the arm housing portion 15 within the connector housing 10 formed along the longitudinal direction of the cantilever arm 25.

Further, as shown in FIGS. 1, 5, 13 and 14, the other connector housing 60 constituting the other connector C2 is provided with the other spacer 80 for doubly engaging the female terminal 90 and the other front holder 70 which protects or holds the female terminal 90 and is abutted against the front holder 20 provided within the connector housing 10 of the one connector C1. The front surface 22*c*' of the front wall 22*c* of the front holder 20 provided within the connector housing 10 constituting the one connector C1 and the front surface 22*c*' of the front wall 72*c* of the other front holder 70 constituting the other connector C2 are abutted and pushed to each other.

According to such an arrangement, the other connector housing 60 constituting the other connector C2 and the other front holder 70 are formed separately. Thus, the members with complicated configurations such as the engagement lance 61*g* provided within the other connector housing 60 can be formed easily, and further the female terminal 90 provided at the other connector housing 60 is protected by the front holder 20. Further, the female terminal 90 provided within the other connector housing 60 is doubly engaged by the other spacer 80 and so the female terminal 90 can be surely attached to the other connector housing 60.

As shown in FIGS. 1, 2, 5, 9, 13 to 16 and 18, the inertia locking portion 64 is provided at the other connector housing 60 and the engaging locking portion 14 is provided at the connector housing 10 in correspondence with the inertia locking portion. The one connector C1 and the other connector C2 are provided with the inertia locking structure, and hence the coupling structure for the connectors is configured that the unfinished engagement can not be performed. When the connectors C1 and C2 provided with the structure for preventing such the half engagement are used, the coupling structure for the connectors with holders can preferably perform the male-female fitting more smoothly.

The relation between a stroke SK and a load LD at the time of fitting the one connector C1 and the other connector C2 will be explained with reference to FIGS. 19 to 21.

In FIGS. 19 to 21, LD depicts a load applied to a subject to be measured and SK depicts a stroke of the subject to be measured. A load cell and a measurement terminal (both not shown) are attached to the subject to be measured, for example, and then the relation between the loads LD applied to the respective subjects to be measured and the strokes SK at the time of moving the respective subjects to be measured was measured.

T, Ts, Tt shown in FIGS. 19 to 21 represent contact timings where the respective subjects to be measured contact at the time of performing such a measuring method. Specifically, Ts represents a timing when the regular engagement and the fitting of the front holder 20 with the connector housing 10 starts due to the abutment between the front holder 20 and the other front holder 70, and Tt represents a timing when the coupling and the fitting between the male terminal 40 and the female terminal 90 starts.

Further, Wr represents the waveform when the engaging locking portion 14 and the retaining lock portion 64 are fitted to each other. Ws represents the waveform at the time of the regular engagement and the fitting of the front holder 20 with the connector housing 10 due to the abutment between the front holder 20 and the other front holder 70. Wt represents the waveform at the time of the coupling and the fitting between the male terminal 40 and the female terminal 90, and Wu represents the waveform at the time of fitting between the one connector C1 and the other connector C2.

FIGS. 16 and 17 show a state where the front holders 20 and 70 start abutting to each other upon fitting of the connectors. Such a state corresponds to portions T of the respective waveforms Wr, Ws, Wt and Wu shown in FIGS. 19 and 20. As shown in FIG. 17, the front surface 22*c*' of the one front holder 20 and the front surface 72*c*' of the other front holder 70 start abutting to each other almost the moment the tab 44 of the male terminal 40 starts abutting against the elastic contact piece 96 of the female terminal 90, and so the loads applied to the front holders 20, 70 and the loads applied to the terminals 40, 90 are generated almost simultaneously.

The insertion force of the male terminal 40 generated upon insertion of the male terminal 40 into the female terminal 90 is arranged to be generated simultaneously with the shifting force generated upon regular engagement of the front holder 20 with the connector housing 10. Thus, it is possible to prevent the generation of a so-called two-step feelings that the contact timing Ts relating to the front holders 20, 70 does not coincide with the contact timing Tt relating to the terminals 40, 90 like the fitting waveform Wu of the connectors as a reference example shown in FIG. 21, and the fitting operation of the connectors can be performed smoothly like the fitting waveform Wu of the connectors shown in FIGS. 19 and 20D. The relation between the load LD and the stroke SK relating to the connectors is represented by the fitting waveform Wu of the connectors shown in FIG. 20D.

In contrast, in the reference example shown in FIG. 21, since the load applied to the front holders and the load applied to the terminals are not generated simultaneously, the fitting waveform Wu of the connectors becomes as shown in the figure and so the fitting feeling of the connectors of the reference example is deteriorated as compared with the invention.

The measuring result of the fitting waveform Wu of the connectors relating to the invention relates to the connectors C1, C2 with the inertia locking mechanism. However, the connectors with the normal locking mechanism can also perform the male-female fitting of the connectors smoothly as long as the timing of the regular engagement of the front holder 20 with the connector housing 10 caused by the abutment of the front holders 20, 70 against the front surfaces 22*c*', 72*c*' is same as the timing of the coupling and the fitting of the terminals 40 and 90. Although the connectors with the normal locking mechanism is not provided with the half-fitting prevention function, the locking mechanism of any type may be employed as long as the object of the invention is attained without causing any trouble.

As described above, according to the invention claimed in claim 1, the regular engagement between the one connector and the one connector housing can be performed simultaneously with the coupling between the terminal of the one connector and the other terminal of the other connector. Thus, the operation feeling at the time of performing the fitting operation between the one connector and the other connector can be improved. Since the regular engagement of the holder is performed by the fitting operation between the connectors, the so-called male-female fitting operation of two-step feeling, in which the regular engagement between the connector housing and the holder is performed separately from the coupling between the terminal of the one connector and the terminal of the other connector. Therefore, it is possible to prevent the occurrence of such a trouble state of the unfinished engagement state, that is, the half engagement state or the unfinished fitting state, that is, the half fitting state of the holder which is feared to be occurred at the time of coupling the connectors.

According to the invention claimed in claim 2 or 3, since the flexible arm portion provided at the holder is protected by the arm housing portion within the one connector housing, the flexible arm portion of the holder is prevented from being exposed outside of the one connector housing. Thus, it is possible to prevent the occurrence of such a trouble that other member hits against the flexible holder to cause plastic deformation at the flexible holder and so the holder regularly engaged with the one connector housing can not be restored to the provisional engagement state.

According to the invention claimed in claim 3, since the flexible arm portion of the holder can be easily maintained at the provisional engagement state and also can be easily maintained at the regular engagement state within the arm housing chamber of the one connector housing. Thus, it is possible to prevent the occurrence of such a trouble that the holder is separated from the one connector housing to be gotten lost and so the terminal provided within the one connector housing is not protected by the holder.

According to the invention claimed in claim 4, when the holder is housed within the one connector housing, the holder can be easily and quickly housed within the one connector housing at the predetermined posture without being broken. Further, the arm portion of the holder can be easily and quickly introduced within the arm housing portion of the one connector housing formed along the longitudinal direction of the arm portion.

According to the invention claimed in claim 5, the other connector housing constituting the other connector and the holder are formed separately. Thus, the members with complicated configurations provided within the other connector housing can be formed easily, and further the other terminal provided at the other connector housing is protected by the front holder. Further, the other terminal provided within the other connector housing is doubly engaged by the other spacer and so the other terminal can be surely attached to the other connector housing.

What is claimed is:

1. A connector coupling structure comprising:

a first connector including a first connector housing, a first terminal accommodated in the first connector housing where said first terminal is engaged by said connector housing, a holder for holding the terminal, and a first spacer accommodated in the first connector housing where said first spacer additionally engages the first terminal; and a second connector including a second connector housing and a second terminal accommodated in the second connector housing;

wherein when a front surface of the second connector pushes with pressure a front surface of the holder housed within the first connector housing for fitting the first connector and the second connector, the holder is regularly engaged with the first connector housing and simultaneously the first terminal is coupled to the second terminal.

2. A connector coupling structure according to claim 1, wherein a flexible arm portion is provided on the holder and an arm housing portion is provided within the first connector housing along a longitudinal direction of the arm portion, and the arm portion is slidable on the arm housing portion along the longitudinal direction of the arm portion.

3. A connector coupling structure according to claim 2, wherein the arm portion of the holder is provided with a flexible space, a provisional stop portion and a regular stop portion, and the arm housing portion of the first connector housing is provided with an arm housing chamber formed by a top wall, a separation wall and a pair of side walls arranged in an enclosure manner, a provisional engagement portion formed by one of the side walls in correspondence with the provisional stop portion and a regular engagement portion formed by the other of the side walls in correspondence with the regular stop portion.

4. A connector coupling structure according to claim 1, wherein a pair of introducing portions are formed at the holder, and a pair of guide portions are formed in the first connector housing.

5. A connector coupling structure according to claim 1, wherein the second connector housing is provided with a second spacer for doubly engaging the second terminal and a front holder which protects or holds the second terminal and is made abut against the first holder.

* * * * *